US011542134B2

(12) United States Patent
Nonogaki et al.

(10) Patent No.: US 11,542,134 B2
(45) Date of Patent: Jan. 3, 2023

(54) CARGO HANDLING CONTROL UNIT OF FORKLIFT

(71) Applicant: KABUSHIKI KAISHA TOYOTA JIDOSHOKKI, Kariya (JP)

(72) Inventors: Yasunori Nonogaki, Aichi-ken (JP); Tatsuya Mita, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 278 days.

(21) Appl. No.: 16/871,742

(22) Filed: May 11, 2020

(65) Prior Publication Data

US 2020/0377350 A1 Dec. 3, 2020

(30) Foreign Application Priority Data

May 27, 2019 (JP) ..... JP2019-098629

(51) Int. Cl.
*B66F 9/06* (2006.01)
*B66F 9/14* (2006.01)
*B66F 9/075* (2006.01)

(52) U.S. Cl.
CPC ..... *B66F 9/063* (2013.01); *B66F 9/0755* (2013.01); *B66F 9/148* (2013.01)

(58) Field of Classification Search
CPC ..... B66F 9/0755; B66F 9/148; B66F 9/063
See application file for complete search history.

(56) References Cited

U.S. PATENT DOCUMENTS

| | | | | |
|---|---|---|---|---|
| 10,138,101 | B2 * | 11/2018 | Svensson | B66F 9/0755 |
| 2016/0075542 | A1 * | 3/2016 | Buchmann | B66F 9/0755 414/667 |
| 2016/0090284 | A1 * | 3/2016 | Svensson | B66F 9/0755 701/50 |
| 2018/0120465 | A1 | 5/2018 | Rose et al. | |
| 2020/0299117 | A1 * | 9/2020 | Sperlich | B60W 30/18009 |

FOREIGN PATENT DOCUMENTS

| | | | | |
|---|---|---|---|---|
| DE | 102008027695 | A1 | 10/2009 | |
| DE | 102008054085 | A1 | 5/2010 | |
| DE | 102017124180 | A1 | 4/2019 | |
| EP | 3020677 | A1 * | 5/2016 | B66F 9/0755 |
| JP | 1993-208799 | A | 8/1993 | |
| JP | 1999-043299 | A | 2/1999 | |
| JP | 2002-087793 | A | 3/2002 | |
| JP | 2013-230903 | A | 11/2013 | |
| JP | 2018-158777 | A | 10/2018 | |
| WO | WO-2005054111 | A1 * | 6/2005 | B66F 9/0755 |
| WO | WO-2019139469 | A1 * | 7/2019 | B66F 17/003 |

* cited by examiner

*Primary Examiner* — Kaitlin S Joerger
(74) *Attorney, Agent, or Firm* — Sughrue Mion, PLLC

(57) ABSTRACT

A cargo handling control unit of a forklift includes a traveling device including a traveling drive unit, forks loading cargos, and a cargo handling device having a lift cylinder. The cargo handling control unit includes at least a pair of one-dimensional laser distance sensors, each of which is configured to emit a one-dimensional laser beam and receives the laser beam reflected from an object, thereby detecting a distance between the object and the one-dimensional laser distance sensor, a picking start position determination unit determining a picking start position of the forks for the cargos, and a picking control unit being configured to control the traveling drive unit and the lift cylinder so as to load the cargos on the forks.

12 Claims, 20 Drawing Sheets

CARGO HANDLING CONTROL UNIT OF FORKLIFT

CROSS-REFERENCE TO RELATED APPLICATION

This application claims priority to Japanese Patent Application No. 2019-098629 filed on May 27, 2019, the entire disclosure of which is incorporated herein by reference.

BACKGROUND ART

The present disclosure relates to a cargo handling control unit of a forklift.

There has been known a technique disclosed, for example, in Japanese Patent Application Publication No. 2013-230903 as a conventional cargo handling control unit of a forklift. The cargo handling control unit disclosed in the Publication includes a two-dimensional laser distance meter, a determination tool, a traveling tool, and a controller. The two-dimensional laser distance meter measures distances and angles between itself and an object by radially emitting a laser beam to the object. The determination tool calculates a position of an upper surface of a cargo loaded on the forklift relative to the forklift by using distances measured by the two-dimensional laser distance meter, between the two-dimensional laser distance meter and the opposite edges of the upper surface of the cargo in a width direction thereof in an scan angle of the two-dimensional laser distance meter, and is configured to determine whether or not a loading position of the cargo is shifted. The traveling tool travels the forklift without an operator in accordance with operation data sent from a driving management system. The controller is configured to pick and place cargos without an operator.

In the above conventional technique, the two-dimensional laser distance meter measures distance between the two-dimensional laser distance meter and a cargo loaded on forks of the forklift in a scan angle of the two-dimensional laser distance meter. However, the two-dimensional laser distance meter is quite expensive. In addition, in the above conventional technique, whether or not a loading position of a cargo is shifted relative to the forks is determined on the basis of measurement values of the two-dimensional laser distance meter. When the loading position of the cargo is shifted relative to the forks, it is required to correct the loading position of the cargo.

The present disclosure is directed to providing a cargo handling control unit of a forklift that loads cargos on forks at a predetermined position thereof with high accuracy while using inexpensive distance sensors.

SUMMARY

In accordance with an aspect of the present disclosure, there is provided a cargo handling control unit of a forklift that includes a traveling device including a traveling drive unit, forks disposed in a front side of the traveling device and loading cargos, and a cargo handling device having a lift cylinder that raises and lowers the forks. The cargo handling control unit includes at least a pair of right and left one-dimensional laser distance sensors disposed on both right and left sides of the cargo handling device. Each of the right and left one-dimensional laser distance sensors is configured to emit a one-dimensional laser beam ahead of the forklift and receive the laser beam reflected from an object that is located in front of the forklift, thereby detecting a distance between the object and the one-dimensional laser distance sensor, a picking start position determination unit determining a picking start position of the forks for the cargos to be picked placed in front of the forklift on the basis of detection values of the pair of the right and left one-dimensional laser distance sensors, and a picking control unit configured to control the traveling drive unit and the lift cylinder so as to load the cargos to be picked on the forks correspondingly to the picking start position determined by the picking start position determination unit.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which:

FIG. 9 is a flowchart showing steps of a control process executed by an

DETAILED DESCRIPTION OF THE EMBODIMENTS

Figure 1:
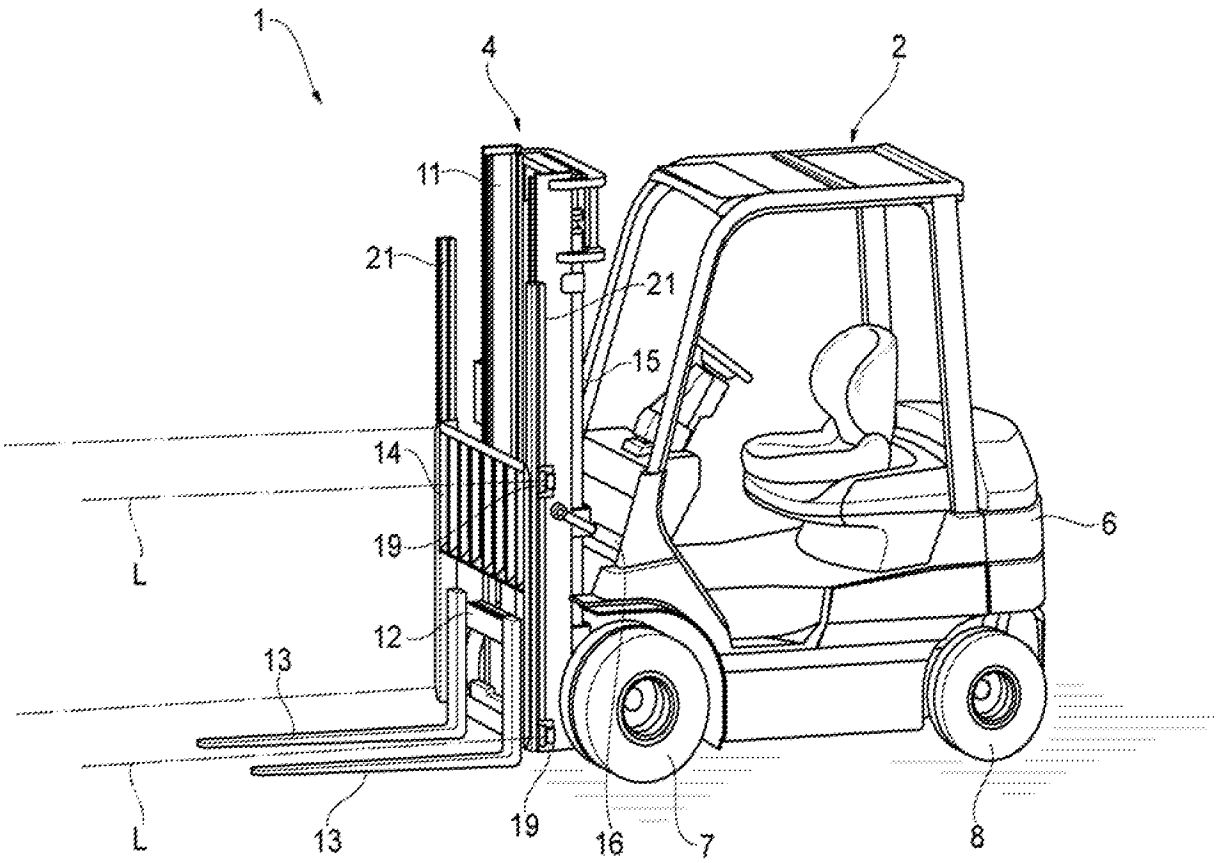
FIG. 1 is a perspective view of a forklift including a cargo handling control unit according to an embodiment of the present disclosure.

The following will describe embodiments of the present disclosure in detail with reference to the accompanying drawings. In the accompanying drawings, identical or equivalent elements are denoted by the same reference numerals, and redundant description is omitted.

FIG. 1 is a perspective view of a forklift including a cargo handling control unit according to an embodiment of the present disclosure. As illustrated in FIG. 1, a forklift 1 according to the present embodiment is a counter-type forklift in one example. The forklift 1 includes a traveling device 2 and a cargo handling device 4 that is disposed in front of the traveling device 2 and configured to pick and place box pallets 3 (see FIGS. 6A, 6B). The box pallets 3 correspond to cargos in the present disclosure.

Figure 2:
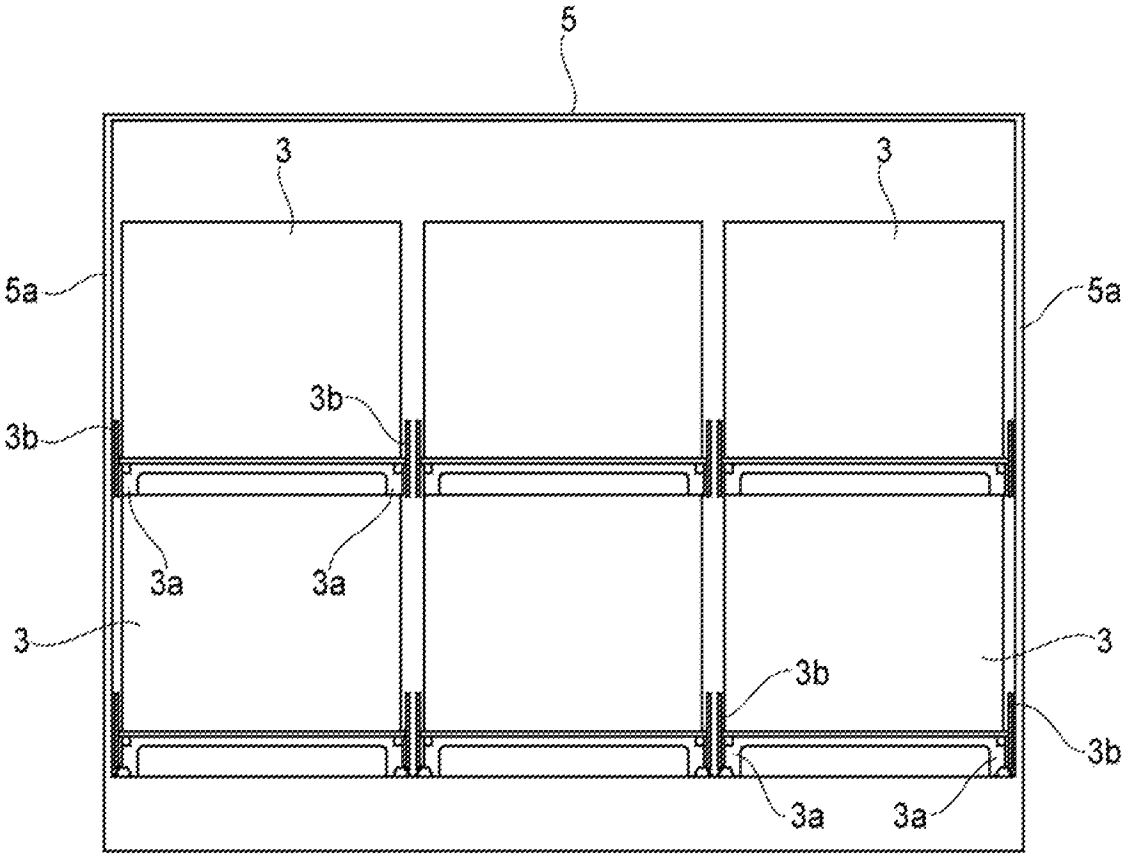
FIG. 2 is a front view of a plurality of box pallets placed on a container according to the embodiment of the present disclosure.

Referring to FIG. 2, the box pallets 3 each have a substantially rectangular parallelepiped shape. The box pallets 3 are accommodated in a container 5 placed on, for example, a trailer cargo bed 26 (see FIGS. 7A, 7B and FIGS. 8A, 8B). The container 5 has on both right and left sides thereof side walls 5*a* (structure). The box pallets 3 are placed on a floor surface of the container 5 and arranged in three rows and two tiers.

Figure 6A:
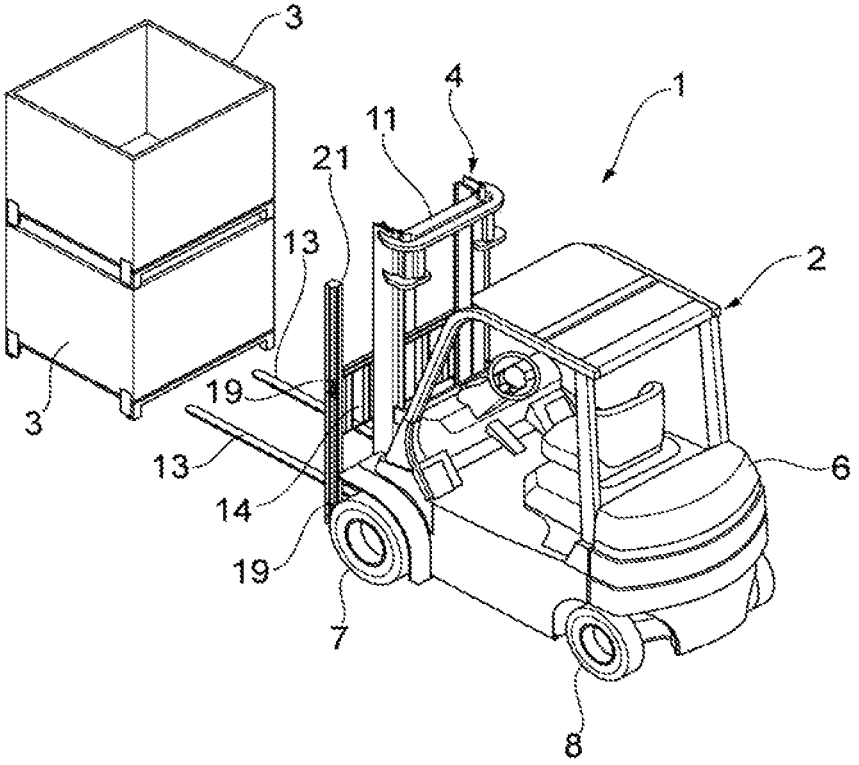
FIGS. 6A, 6B are perspective views showing a picking work by the forklift.
Figure 6B:
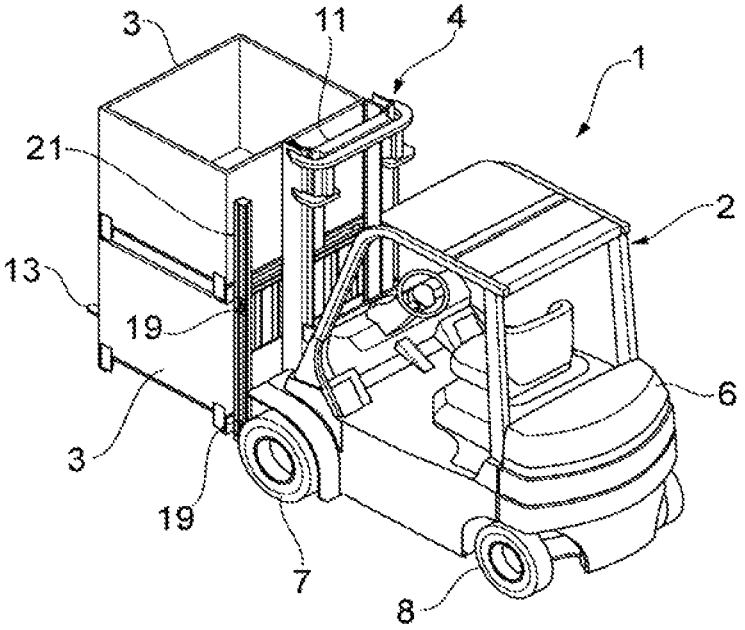

The box pallets 3 are open at upper ends of the box pallets 3 (see FIGS. 6A, 6B). Base portions 3*a* and fasteners 3*b* are provided in four corner portions that are located on a lower end of each box pallet 3. While the box pallets 3 are stacked in two tiers, the base portions 3*a* of the box pallets 3 in an upper tier are placed on the upper ends of the box pallets 3 in a lower tier. The box pallets 3 in the upper and lower tiers are locked with each other by the fasteners 3*b*.

Figure 3:
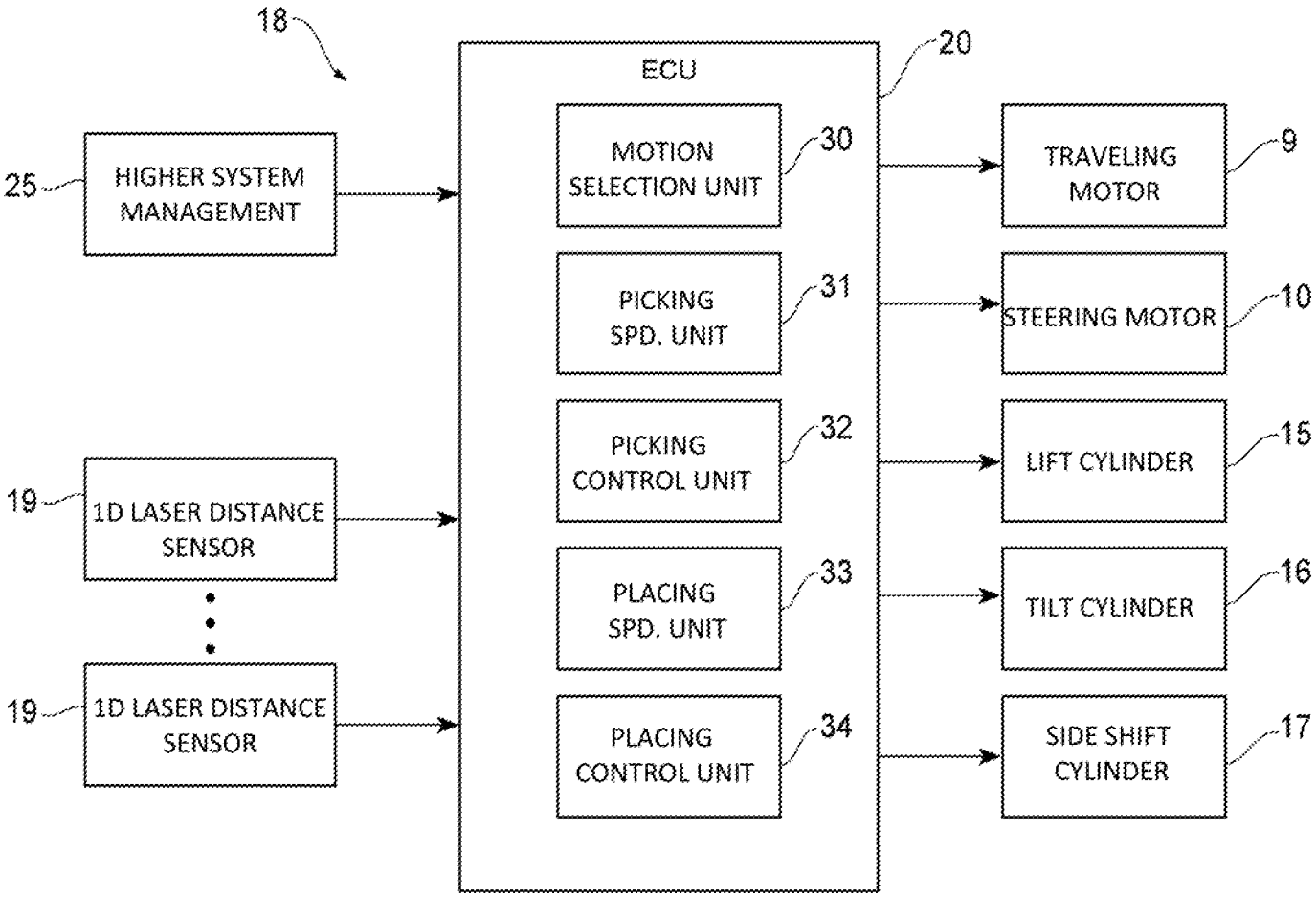
FIG. 3 is a block diagram showing a configuration of the cargo handling control unit according to the embodiment of the present disclosure.

The traveling device 2 includes a body 6, front wheels 7, rear wheels 8, a traveling motor 9 (see FIG. 3), and a steering motor 10 (see FIG. 3). The front wheels 7 are disposed in a front portion of the body 6 on the right and left sides thereof and serve as driving wheels. The rear wheels 8 are disposed in a rear portion of the body 6 on the right and left sides thereof and serve as steered wheels. The traveling motor 9 rotates the front wheels 7. The steering motor 10 steers the rear wheels 8 by rotating a steering shaft of the forklift 1.

The cargo handling device 4 has a mast 11, a lift bracket 12, a pair of forks 13, and a backrest 14. The mast 11 is provided upright on a front end portion of the body 6 of the traveling device 2. The forks 13 are attached to the mast 11 with the lift bracket 12 interposed therebetween and allowed to be raised and lowered. The forks 13 load the box pallets 3. The forks 13 are disposed in a front side of the traveling device 2. The backrest 14 is fixed to the lift bracket 12 and disposed in front of the mast 11. The backrest 14 is a load receiving frame to prevent the box pallet 13 loaded on the forks 13 from moving backward, that is, toward the body 6. A width dimension of the backrest 14 is larger than that of the mast 11.

The cargo handling device 4 has a lift cylinder 15 that raises and lowers the forks 13, a tilt cylinder 16 that tilts the mast 11, and a side shift cylinder 17 that shifts the forks 13 relative to the mast 11 in a right and left direction (vehicle width direction) of the body 6 (see FIG. 3).

FIG. 3 is a block diagram showing a configuration of a cargo handling control unit according to the embodiment of the present disclosure. As illustrated in FIG. 3, a cargo handling control unit 18 of the present embodiment is mounted on the forklift 1. The cargo handling control unit 18 performs control of cargos, such as picking and placing of the cargos during automatic operation of the forklift 1. It is noted that the picking in the present embodiment herein refers to loading the box pallets 3 placed on a specified place onto the forks 13, and the placing in the present embodiment refers to placing the box pallets 3 loaded on the forks 13 on a floor surface of the container 5.

The cargo handling control unit 18 includes two pairs of one-dimensional laser distance sensors 19 (hereinafter, called 1D laser distance sensors) disposed on both right and left sides of the cargo handling device 4 and an ECU 20 (Electronic Control Unit) connected to the 1D laser distance sensors 19.

Referring to FIG. 1, the 1D laser distance sensors 19 are each configured to emit a one-dimensional laser beam L ahead of the forklift 1 and receive the laser beam L (reflected light) reflected from an object that is located in front of the forklift 1, thereby detecting a distance between the object and the 1D laser distance sensor 19. The one-dimensional laser beam L is a linear laser beam. The 1D laser distance sensors 19 are attached on both right and left sides of the backrest 14.

Figure 4:
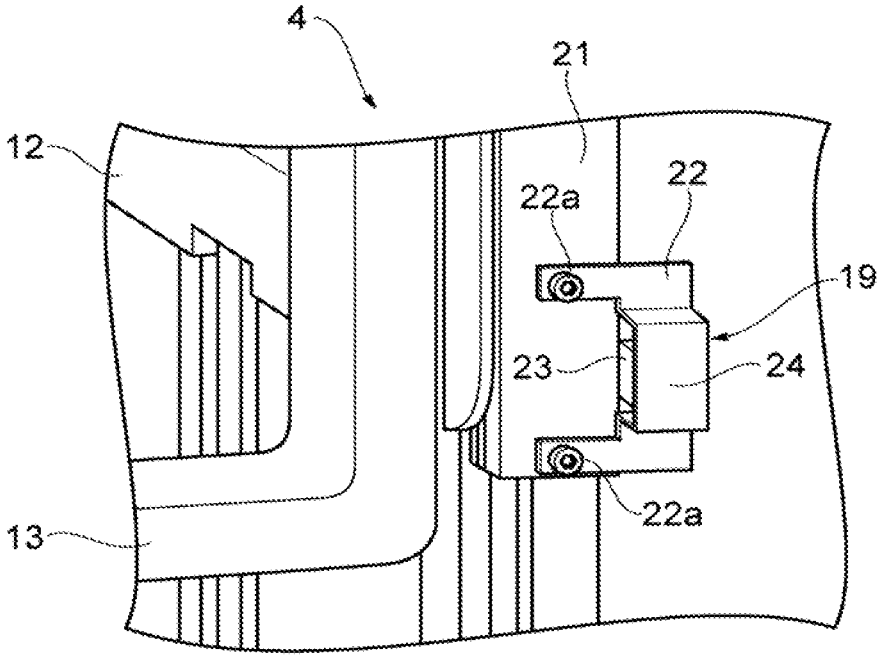
FIG. 4 is an enlarged perspective view of a part of a cargo handling device including a one-dimensional (1D) laser distance sensor.
Figure 5:
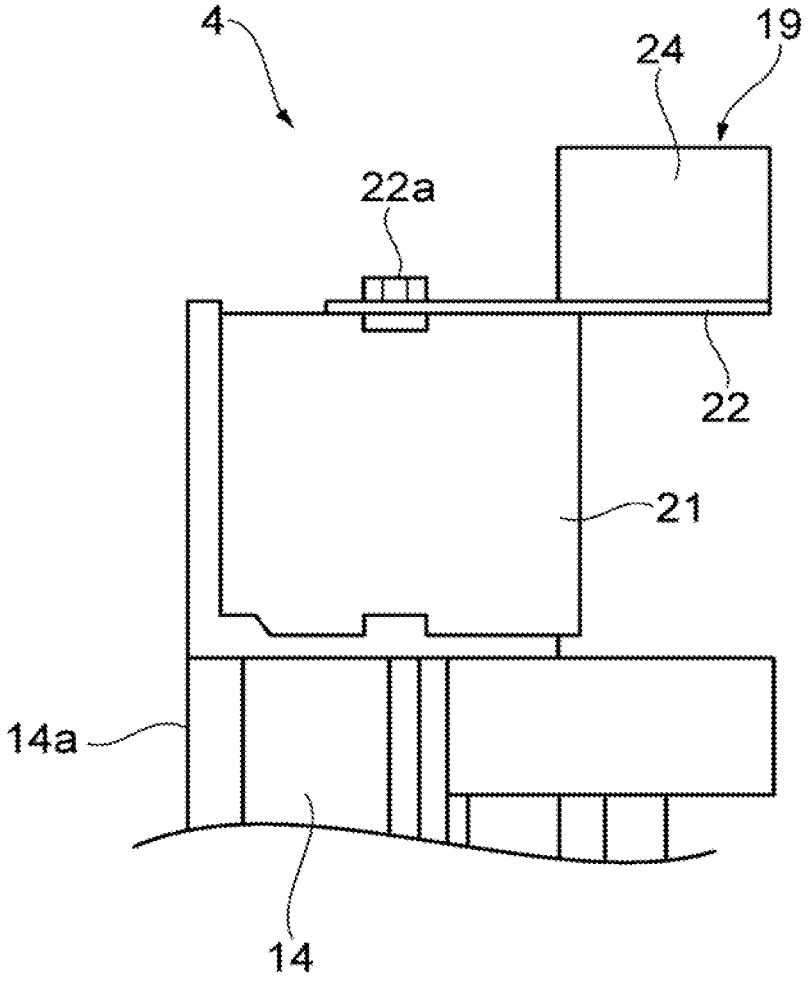
FIG. 5 is an enlarged plan view of the part of the cargo handling device including the 1D laser distance sensor.

Specifically, referring to FIG. 4 and FIG. 5, aluminum frames 21 that extend in an upper and lower direction of the body 6 are fixed to side surfaces of the backrest 14 on the both right and left sides thereof. The 1D laser distance sensors 19 are attached to outer side surfaces of the aluminum frames 21 with brackets 22 interposed therebetween. Specifically, four 1D laser distance sensors 19 are attached to the right and left aluminum frames 21 so as to be located in symmetry. Each aluminum frame 21 has the two of the four 1D laser distance sensors 19, which are located in the upper and lower direction of the aluminum frames 21. It is noted that FIG. 4 is an enlarged perspective view, and FIG. 5 is an enlarged plan view as viewed from an upper side of the forklift 1.

The two 1D laser distance sensors 19, that is, the upper 1D laser distance sensor and the lower 1D laser distance sensor of each aluminum flame 21, are arranged at an interval corresponding to a height dimension of each box pallet 3. The lower 1D laser distance sensor 19 is attached to a lower end portion of each aluminum frame 21 in one example. The upper 1D laser distance sensor 19 is attached to each aluminum frame 21 in a position corresponding to an upper end portion of the backrest 14 in one example. While the box pallets 3 are stacked on the forks 13 in two tiers, the 1D laser distance sensors 19 are each attached in a position corresponding to a lower end portion of one box pallet 3 (see FIGS. 6A, 6B).

A pair of right and left 1D laser distance sensors 19 are arranged at a slightly larger interval than the maximum width dimension (maximum dimension in a longitudinal direction of the forklift 1) of each box pallet 3. The maximum width dimension of each box pallet 3 is equal to a width dimension of a lower end portion of the box pallet 3 which has the fasteners 3*b*. Thus, while the box pallets 3 are picked on the forks 13 at a desired position, the one-dimensional laser beams emitted from 1D laser distance sensors 19 pass by an outer side of the box pallets 3, that is, the one-dimensional laser beams do not hit the box pallets 3. In addition, while the box pallets 3 are picked on the forks 13 at a position which is shifted from the desired position, a one-dimensional laser beam emitted from either of the pair of right and left 1D laser distance sensors 19 may hit the box pallets 3. However, in this case, one-dimensional laser beams emitted from both of the pair of right and left 1D laser distance sensors 19 do not hit one box pallet 3. It is noted that the desired position is defined as a position in which a centerline of the box pallets 3 in a width direction of thereof are aligned with a centerline between the forks 13.

One 1D laser distance sensor 19 is attached to each aluminum frame 21 by bolts 22*a* with the bracket 22 interposed therebetween so as to be disposed behind a front surface 14*a* of the backrest 14. The 1D laser distance sensors 19 each have a detection portion 23 and a cover portion 24. The detection portion 23 emits a one-dimensional laser beam, receives reflected light from an object, and outputs electric signals showing a detection value, which is a distance between the object and the 1D laser distance sensor 19. The cover portion 24 covers the detection portion 23. The cover portion 24 is fixed to the bracket 22 by bolts or welding.

The ECU 20 is configured of a CPU, a RAM, a ROM, and input/output interfaces and the like. The ECU 20 is connected to a higher system management unit 25. The higher system management unit 25 manages the overall automatic operation of the forklift 1, including a cargo handling operation, and instructs the ECU 20 in the automatic operation.

The ECU 20 performs predetermined processing in accordance with instruction signals from the higher system management unit 25 and detection values of the 1D laser distance sensors 19, controlling the traveling motor 9, the steering motor 10, the lift cylinder 15, the tilt cylinder 16, and the side shift cylinder 17. The traveling motor 9 and the steering motor 10 correspond to the traveling drive unit in the present disclosure.

The following will describe basic motions of a cargo handling operation by an automatic operation of the forklift 1. When the picking work is started, the forklift 1 is moved in front of the box pallets 3 placed on a specified place, as shown in FIG. 6A. Subsequently, the forks 13 are slightly raised by the lift cylinder 15 while the forks 13 are inserted under the box pallets 3, as shown in FIG. 6B. With these motions, the box pallets 3 are loaded on the forks 13. In this time, the mast 11 may be tilted backward by the tilt cylinder 16.

Figure 7A:
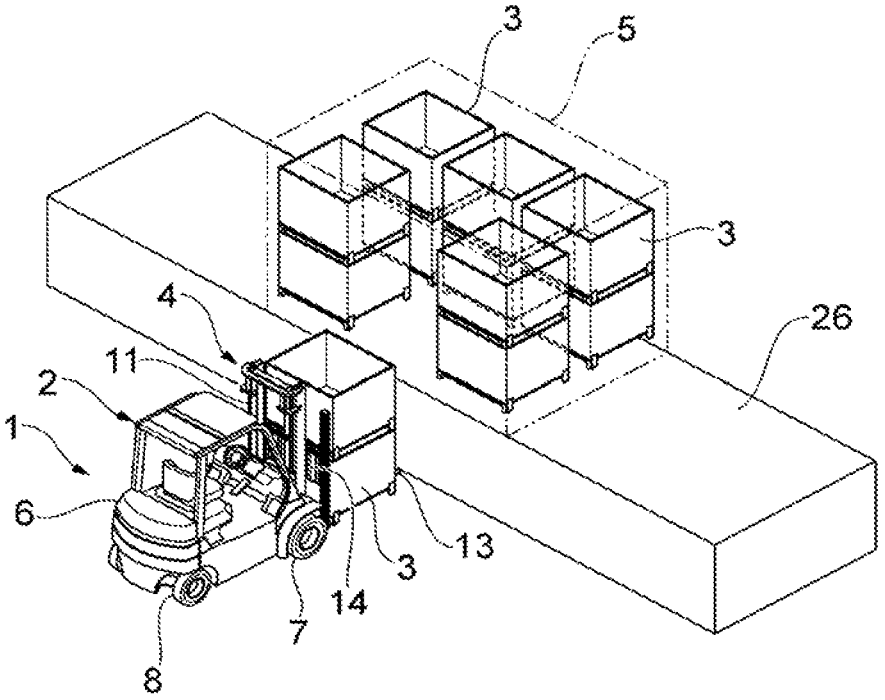
FIGS. 7A, 7B are perspective views showing a placing work by the forklift.
Figure 7B:
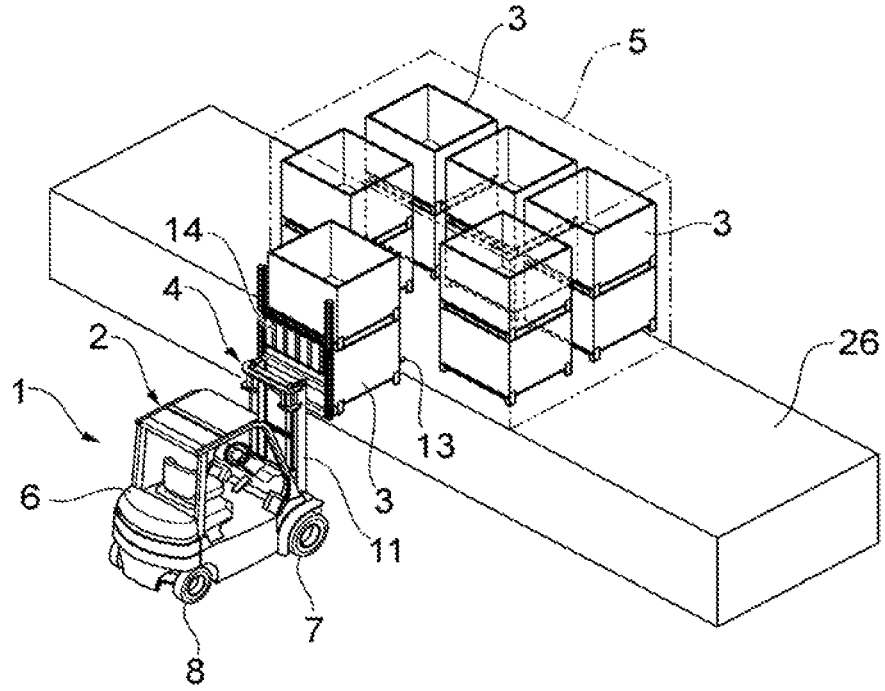

When the placing work is started following the picking work, the forklift 1 is moved to the trailer cargo bed 26, as shown in FIG. 7A. The forklift 1 is stopped in front of a position (placing position) at which the box pallets 3 are to be placed on the container 5, which is placed on the trailer cargo bed 26. The forks 13 are raised to a height of the container 5 by the lift cylinder 15, as shown in FIG. 7B.

Figure 8A:
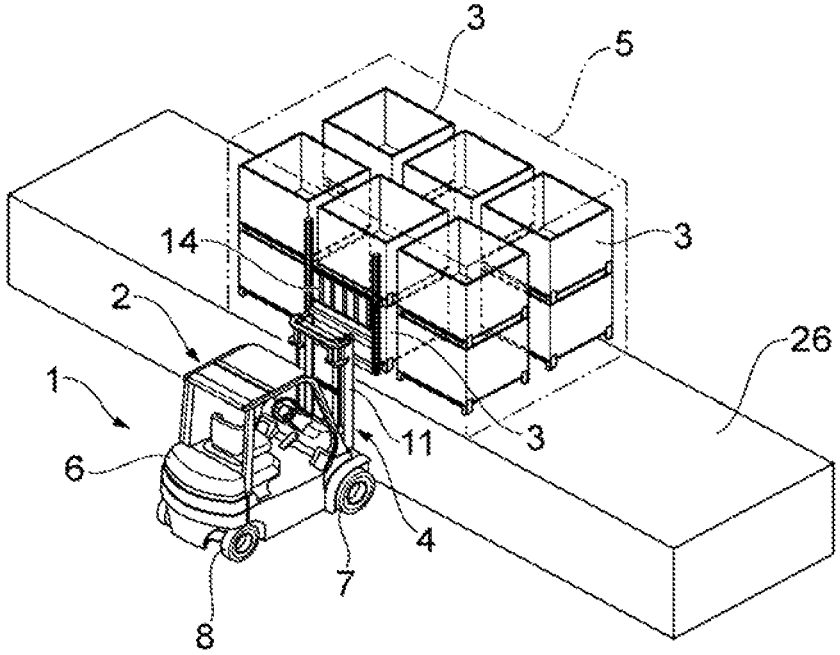
FIGS. 8A, 8B are perspective views showing the placing work by the forklift following FIGS. 7A and 7B.
Figure 8B:
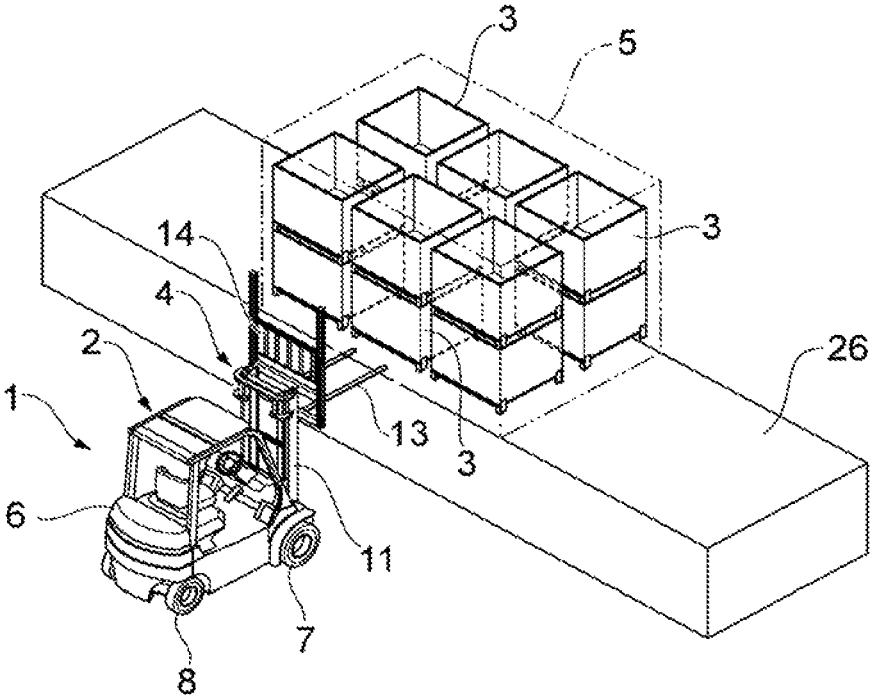

Subsequently, the forklift 1 is moved forward to the placing position, and the forks 13 are slightly lowered by the lift cylinder 15, as shown in FIG. 8A. With these motions, the box pallets 3 loaded on the forks 13 are placed on the placing position of the container 5. The forklift 1 is moved backward as shown in FIG. 8B, and then, moved to a specified place again. It is noted that the container 5 is illustrated by two-dot chain lines for the ease of viewing the box pallets 3 in FIGS. 7A, 7B and FIGS. 8A, 8B.

Referring back to FIG. 3, the ECU 20 works while a picking work or a placing work above described is performed. The ECU 20 has a motion selection unit 30, a picking start position determination unit 31 (hereinafter, called picking SPD unit 31), a picking control unit 32, a placing start position determination unit 33 (hereinafter, called placing SPD unit 33), and a placing control unit 34.

The motion selection unit 30 selects a motion performed by the forklift 1 on the basis of instruction signals sent from the higher system management unit 25. The performed motions by the forklift 1 include a picking motion, a placing motion, and a moving motion.

The picking SPD unit 31 determines a picking start position of the forks 13 for the box pallets 3 to be picked placed in front of the forklift 1 on the basis of detection values of at least the pair of right and left 1D laser distance sensors 19. The picking start position of the forks 13 corresponds to a middle position of the box pallets 3 in a width direction thereof.

The picking control unit 32 is configured to control the traveling motor 9, the steering motor 10, the lift cylinder 15, the tilt cylinder 16, and the side shift cylinder 17 so as to load the box pallets 3 to be picked on the forks 13 correspondingly to the picking start position determined by the picking start position determination unit 31.

The placing SPD unit 33 determines a placing start position of the forks 13 on the basis of detection values of at least the pair of right and left 1D laser distance sensors 19.

The placing control unit 34 is configured to control the traveling motor 9, the steering motor 10, the lift cylinder 15, the tilt cylinder 16, and the side shift cylinder 17 correspondingly to the placing start position determined by the placing SPD unit 33 so as to place the box pallets 3 to be placed loaded on the forks 13.

Figure 9:
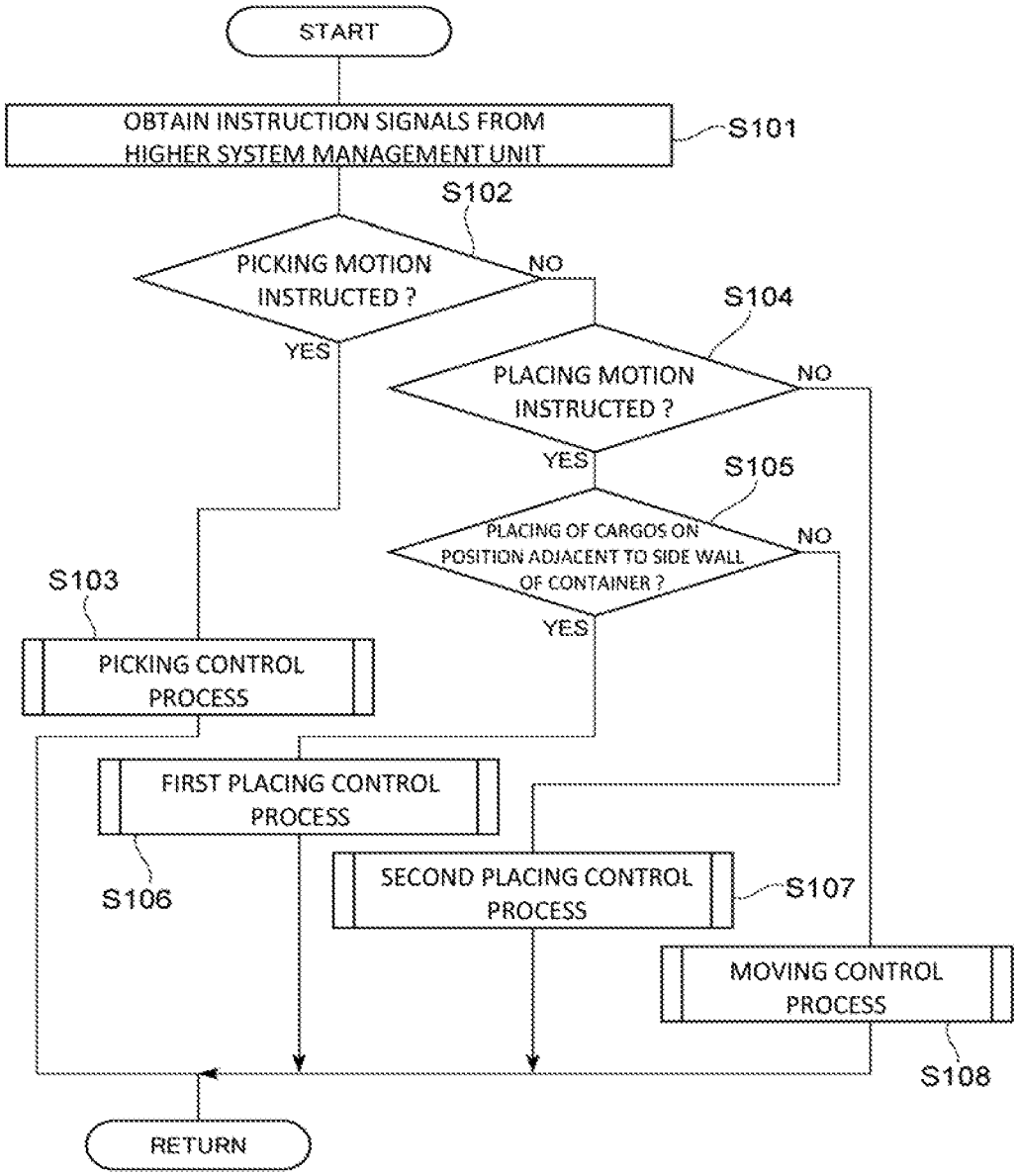

FIG. 9 is a flowchart showing steps of the cargo handling control process executed by the ECU 20. As illustrated in FIG. 9, the ECU 20 firstly obtains instruction signals from the higher system management unit 25 (step S101).

The ECU 20 determines whether or not a picking motion of the motions performed by the forklift 1 has been instructed on the basis of instruction signals from the higher system management unit 25 (step S102). When the ECU 20 determines that the picking motion has been instructed (YES at S102), the ECU 20 performs the picking control process for the picking motion (step S103). The picking control process is described in detail later.

When the ECU 20 determines that the picking motion has not been instructed (NO at S102), the ECU 20 determines whether or not a placing motion of the motions performed by the forklift 1 has been instructed on the basis of instruction signals from the higher system management unit 25 (step S104). When the ECU 20 determines that the placing motion has been instructed (YES at S104), the ECU 20 determines whether or not the instructed placing motion is the placing of the box pallets 3 on a position adjacent to either of the left or right side walls 5*a* of the container 5, on the basis of instruction signals from the higher system management unit 25 (step S105).

When the ECU 20 determines that the instructed placing motion is the placing of the box pallets 3 on the position adjacent to either of the side walls 5*a* of the container 5 (YES at S105), the ECU 20 executes a first placing control process for the placing of the box pallets 3 on the position adjacent to either of the side walls 5*a* of the container 5 (step S106). The first placing control process will be described in detail later.

When the ECU 20 determines that the instructed placing motion is not the placing of the box pallets 3 on the position adjacent to either of the side walls 5*a* of the container 5 (NO at S105), the ECU 20 executes a second placing control process for the placing of the box pallets 3 on a position between existing two box pallets 3 placed in advance (step S107). The second placing control process will be described in detail later.

When the ECU 20 determines that the placing motion of the motions performed by the forklift 1 at the step S104 has not been instructed (NO at S104), the ECU 20 executes a moving control process for the moving of the forklift 1 to a picking place, a placing place, a storage place, or the like (step S108). Detailed descriptions of the moving control process are omitted in the present embodiment.

The steps S101, S102, S104, and S105 are executed by the motion selection unit 30. The step 103 is executed by the picking SPD unit 31 and the picking control unit 32. The steps 106 and 107 are executed by the placing SPD unit 33 and the placing control unit 34.

Figure 10:
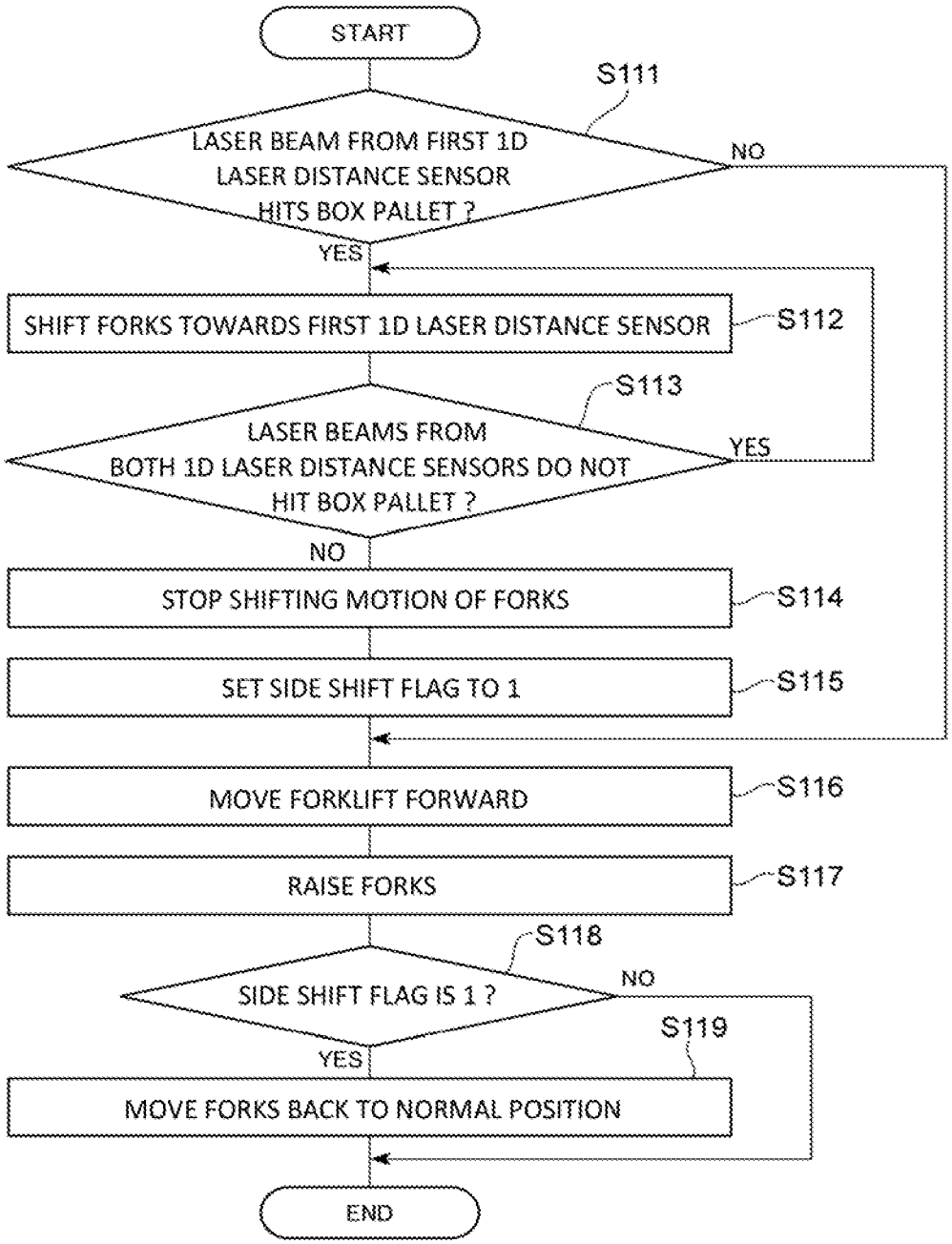
FIG. 10 is a flowchart showing detail steps of a picking control process shown in FIG. 9.

FIG. 10 is a flowchart showing detailed steps (step S103) of the picking control process shown in FIG. 9. The picking control process is executed by using detection values of the pair of right and left 1D laser distance sensors 19 located in the upper or lower end portion of the aluminum frames 21. Before the picking control process is started, the forklift 1 stops in front of the box pallets 3 to be picked, as shown in FIG. 6A. The forks 13 are located at the bottom level in a movable range of the forks 13. The side shift flag is set to 0.

As illustrated in FIG. 10, the ECU 20 determines whether or not a laser beam emitted from a first 1D laser distance sensor 19 of the pair of the right and left 1D laser distance sensors 19 hits the box pallets 3 to be picked placed in front of the forklift 1 (step S111) on the basis of detection values of the pair of right and left 1D laser distance sensors 19. It is noted that in the present disclosure, when the left 1D laser distance sensor 19 is defined as the first 1D laser distance sensor 19, the right 1D laser distance sensor 19 is defined as the second 1D laser distance sensor 19, and when the right 1D laser distance sensor 19 is defined as the first 1D laser distance sensor 19, the left 1D laser distance sensor 19 is defined as the second 1D laser distance sensor 19. Approximate distances between the 1D laser distance sensors 19 and the box pallets 3 to be picked are known in advance.

When the ECU 20 determines that the laser beam emitted from the first 1D laser distance sensor 19 hits the box pallets 3 to be picked (see FIG. 11A) (YES at S111), the ECU 20 controls the side shift cylinder 17 so that the forks 13 are shifted from a normal position toward the first 1D laser distance sensor 19 (step S112). The normal position is a middle position of the mast 11 in a width direction (right and left direction) thereof.

Subsequently, the ECU 20 determines whether or not laser beams emitted from both 1D laser distance sensors 19 hit the box pallets 3 to be picked on the basis of detection values of the pair of right and left 1D laser distance sensors (step S113). When the ECU 20 determines that the laser beam from the first 1D laser distance sensor 19 still hits the box pallets 3 to be picked (YES at S113), the ECU 20 executes the step S112 again.

When the ECU 20 determines that the laser beams emitted from both 1D laser distance sensors 19 do not hit the box pallets 3 to be picked (see FIG. 11B) (NO at S113), the ECU 20 then determines the current position of the forks 13 as a picking start position, and controls the side shift cylinder 17 so that the forks 13 stop the current shifting motion (step S114). The ECU 20 sets the side shift flag to 1 (step S115).

Figures 11A, 11B, 11C, 11D:
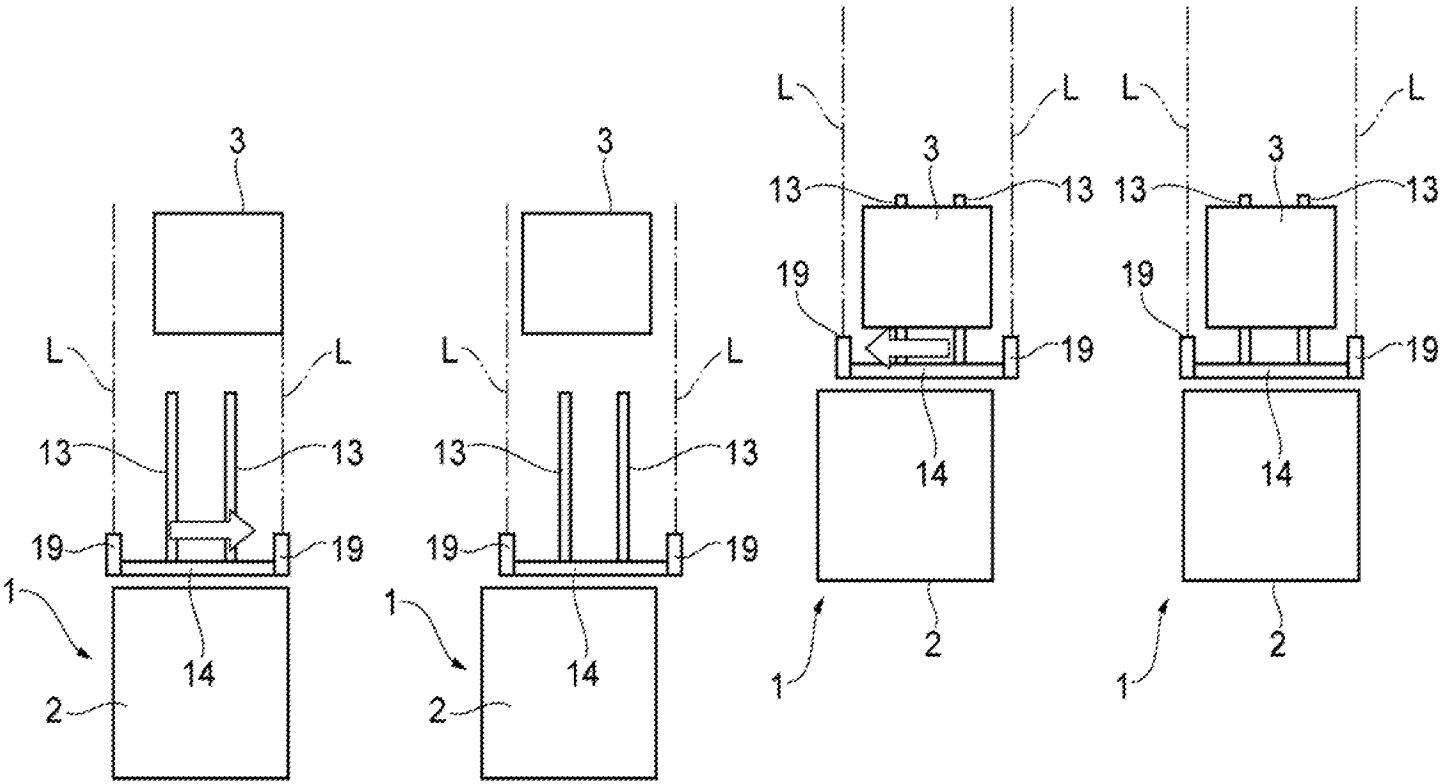
FIGS. 11A-11D are plan views schematically showing picking motions of the forklift by the picking control process shown in FIG. 10.

When the ECU 20 determines that the laser beams emitted from both 1D laser distance sensors 19 do not hit the box pallets 3 to be picked (NO at S111) or after the ECU 20 executes the step S115, the ECU 20 controls the traveling motor 9 so that the forklift 1 moves forward to a picking position (step S116) (see FIG. 11C). The ECU 20 controls the lift cylinder 15 so that the forks 13 are raised by a predetermined amount (step S117). With this process, the box pallets 3 to be picked are loaded on the forks 13 as shown in FIG. 6B.

Subsequently, the ECU 20 determines whether or not the side shift flag is 1 (step S118). When the ECU 20 determines that the side shift flag is not 1 but 0 (NO at S118), the ECU 20 ends the present process. When the ECU 20 determines that the side shift flag is 1 (YES at S118), the ECU 20 controls the side shift cylinder 17 so that the forks 13 are moved back to the normal position (see FIG. 11D) (step S119) and ends the present process.

The steps S111 to S114 are executed by the picking SPD unit 31. The steps S115 to S119 are executed by the picking control unit 32.

FIGS. 11A-11D are plan views schematically showing motions of the forklift performing picking by the picking control process shown in FIG. 10. As illustrated in FIGS. 11A-11D, when the laser beam L emitted from the right 1D laser distance sensor 19 hits the box pallets 3 to be picked, the forks 13 are shifted to the right, as shown in FIG. 11A.

when the forks 13 are brought to a position in which the laser beam L emitted from the right 1D laser distance sensor 19 does not hit the box pallets 3 to be picked, the forks 13 stop the current shift motion as shown in FIG. 11B.

Subsequently, the forklift 1 is moved forward to a picking position. The forks 13 are inserted under the box pallets 3 at that position, and raise the box pallets 3, as shown in FIG. 11C. Then, the forks 13 are shifted to the left, the forks 13 are moved back to the normal position, as shown in FIG. 11D.

Figure 12:
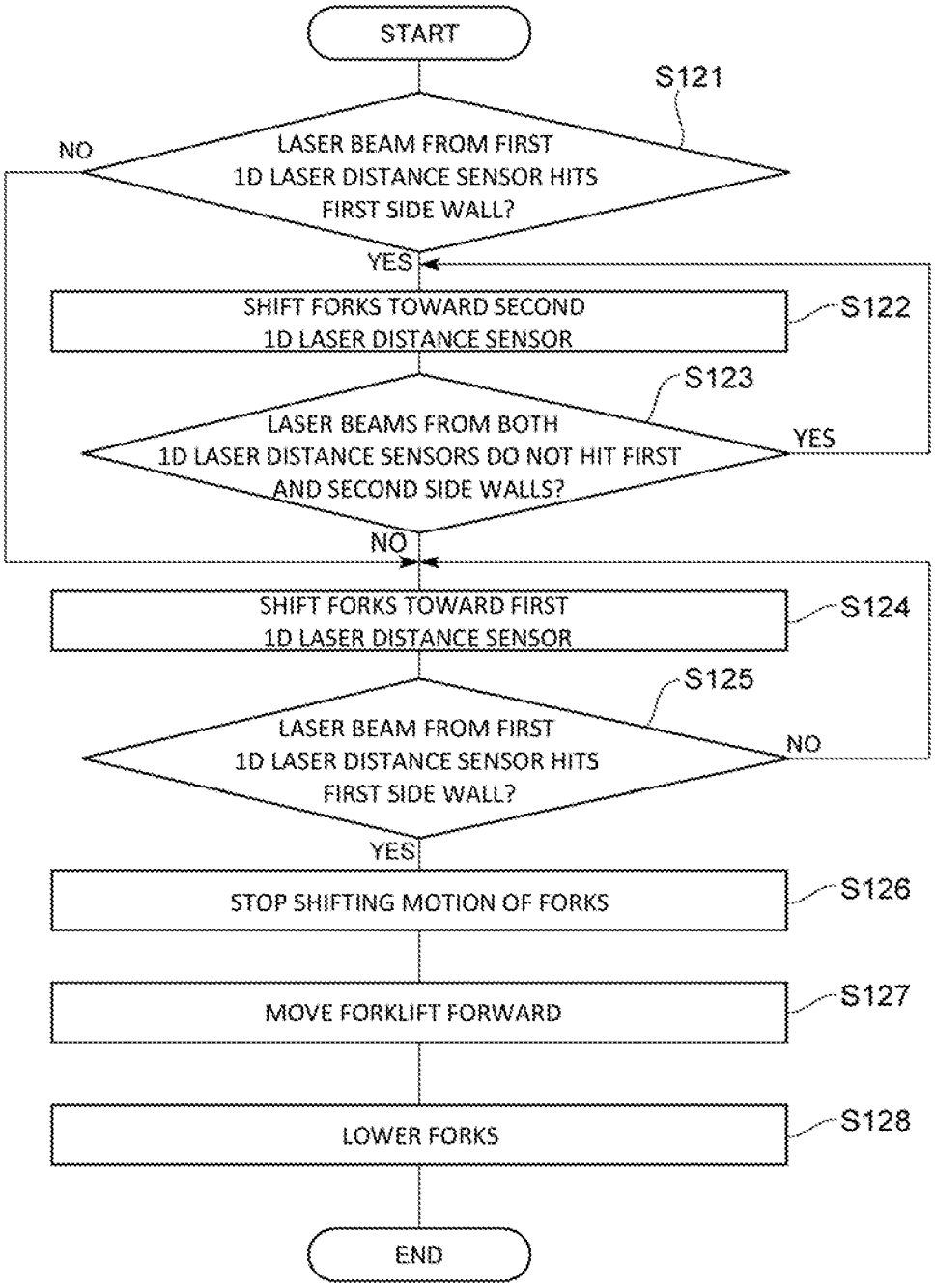
FIG. 12 is a flowchart showing detail steps of first placing control process shown in FIG. 9.

FIG. 12 is a flowchart showing detail steps of the first placing control process (step S106) shown in FIG. 9. It is noted that the first placing control process is executed by using detection values of the pair of right and left 1D laser distance sensors 19 located in the upper or lower end portion of the aluminum frames 21 similarly to the above picking control process. Before the present placing control process is started, the forklift 1 stops in front of and near either of the right and left side walls 5*a* of the container 5. The forks 13 are set to a predetermined height.

As illustrated in FIG. 12, the ECU 20 determines whether or not a laser beam emitted from the first 1D laser distance sensor 19 of the pair of right and left 1D laser distance sensors 19 hits a first side wall 5*a* on the basis of detection values of the pair of right and left 1D laser distance sensors 19. It is noted that the first side wall 5*a* is defined as the side wall 5*a* which a laser beam emitted from the first 1D laser distance sensor 19 hits, and a second side wall 5*a* is defined as the side wall 5*a* which a laser beam emitted from the second 1D laser distance sensor hits. Approximate distances between the 1D laser distance sensors 19 and the side walls 5*a* are known in advance.

When the ECU 20 determines that the laser beam emitted from the first 1D laser distance sensor 19 hits the first side wall 5*a* (see FIG. 13A) (YES at S121), the ECU 20 controls the side shift cylinder 17 so that the forks 13 are shifted toward the second side wall 5*a* of the container 5 on the opposite side of the first side wall 5*a* (toward the second 1D laser distance sensor 19) (step S122).

The ECU 20 determines whether or not laser beams emitted from both 1D laser distance sensors 19 hit the first and second side walls 5*a* on the basis of detection values of the pair of right and left 1D laser distance sensors 19 (step S123). When the ECU 20 determines that the laser beam emitted from the first 1D laser distance sensor 19 still hits the first side wall 5*a* (YES at S123), the ECU 20 executes the step S122 again.

When the ECU 20 determines that the laser beams emitted from both 1D laser distance sensors 19 do not hit the first and second side walls 5*a* at the step S121 (see FIG. 14A) (NO at S121), or at the step S123 (see FIG. 13B) (NO at S123), the ECU 20 controls the side shift cylinder 17 so that the forks 13 are shifted toward the first side wall 5*a* of the container 5 (step S124).

Subsequently, the ECU 20 determines whether or not the laser beam emitted from the first 1D laser distance sensor of the pair of right and left 1D laser distance sensors 19 hits the first side wall 5*a* on the basis of detection values of the pair of right and left 1D laser distance sensors 19 (step S125). When the ECU 20 determines that the laser beams emitted from both 1D laser distance sensors 19 do not hit the first and second side wall 5*a* (NO at S125), the ECU 20 executes the step S124 again.

When the ECU 20 determines that the laser beams emitted from the first 1D laser distance sensor 19 hits the first side wall 5*a* (see FIG. 13C and FIG. 14B) (YES at S125), the ECU 20 then determines the current position of the forks 13 as a placing start position, and controls the side shift cylinder 17 so that the forks 13 stop the current shifting motion (step S126).

Subsequently, the ECU 20 controls the traveling motor 9 so that the forklift 1 is moved forward from the placing start position to the placing position (step S127). The ECU 20 controls the lift cylinder 15 so that the forks 13 are lowered by a predetermined amount (step S128). With this process, the box pallets 3 to be placed loaded on the forks 13 are placed on the floor surface of the container 5 (see FIG. 13D and FIG. 14C).

The steps S121 to S126 are executed by the placing SPD unit 33. The steps S127 and S128 are executed by the placing control unit 34.

FIGS. 13A-13D are plan views schematically showing placing motions of the forklift performed adjacently to the left side wall 5*a* of the container 5 by the first placing control process shown in FIG. 12. In the present embodiment, the box pallets 3 have already been placed in three rows on the container 5 on the back side thereof, which is a side not facing the forklift 1.

Figure 13A:
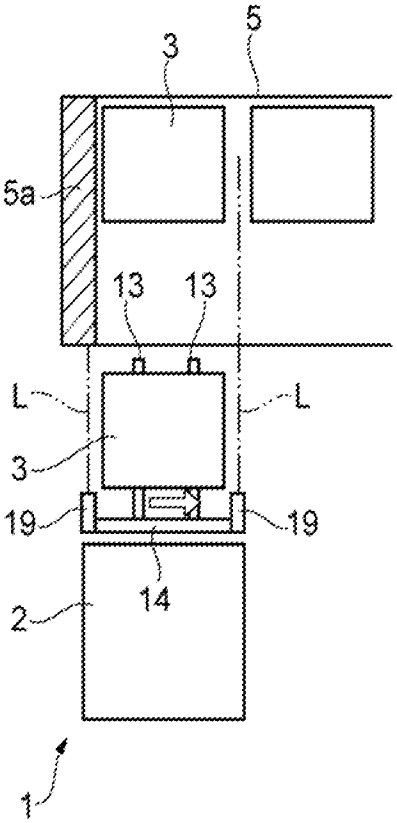
FIGS. 13A-13D are plan views schematically showing placing motions of the forklift performed adjacently to a side wall of the container by the first placing control process shown in FIG. 12.

As illustrated in FIG. 13A, when the laser beam L emitted from the left 1D laser distance sensor 19 hits the left side wall 5*a* while the forklift 1 is stopped in front of and near the left side wall 5*a* of the container 5, the forks 13 are shifted to the right.

Figure 13B:
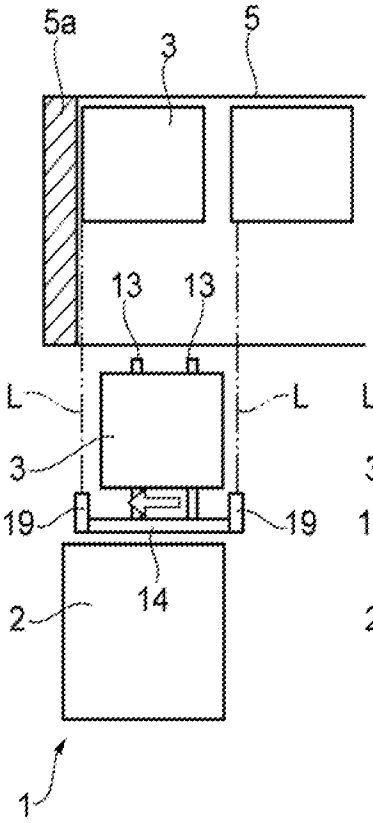
Figure 13C:
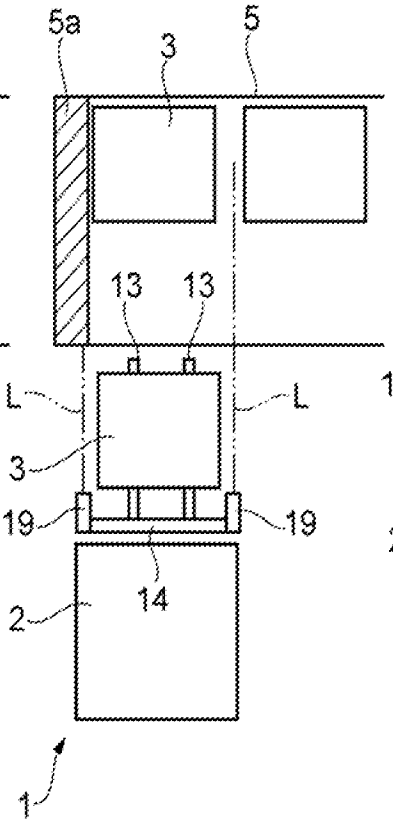

As illustrated in FIG. 13B, when the forks 13 are brought to a position in which the laser beam L emitted from the left 1D laser distance sensor 19 does not hit the left side wall 5*a*, the forks 13 are then shifted to the left in this time. As illustrated in FIG. 13C, when the forks 13 are brought to a position (placing starting position) in which the laser beam L emitted from the left 1D laser distance sensor 19 hits the left side wall 5*a* again, the forks 13 stop the current shifting motion.

Figure 13D:
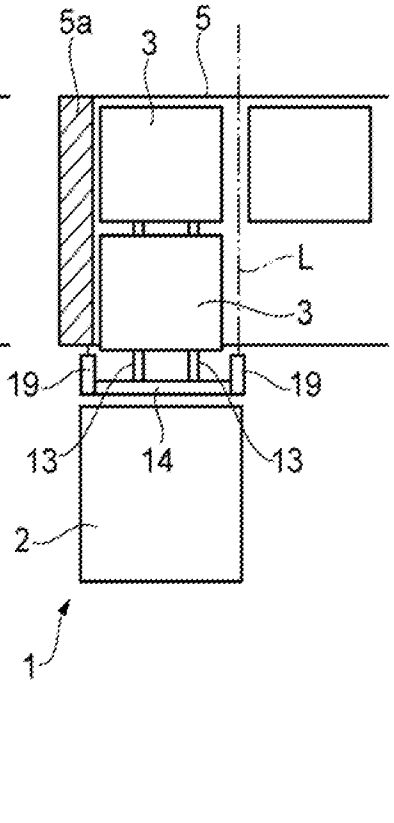

As illustrated in FIG. 13D, the forklift 1 is moved forward to the placing position, and the forks 13 are lowered at the stoppage position. With these motions, the box pallets 3 to be placed loaded on the forks 13 are placed on the floor surface of the container 5 adjacently to the left side wall 5*a*.

Figure 14C:
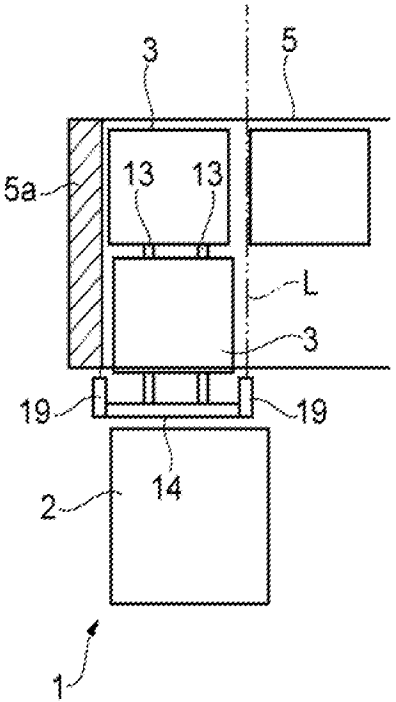
FIGS. 14A-14C are plan views schematically showing another placing motions of the forklift performed adjacently to the side wall of the container by the first placing control process shown in FIG. 12.
Figure 14B:
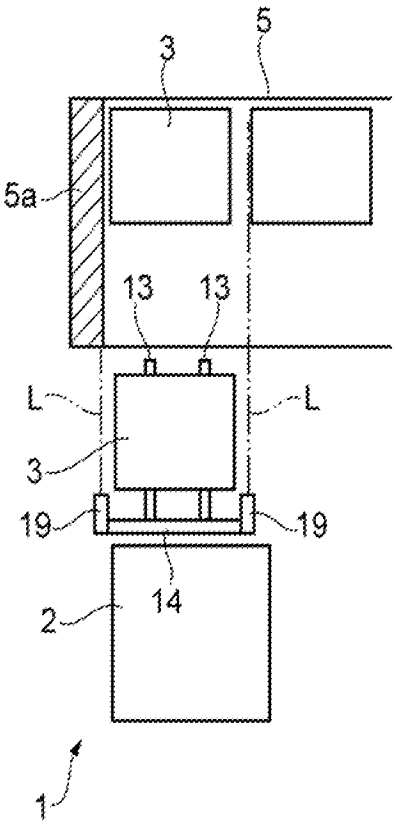
Figure 14A:
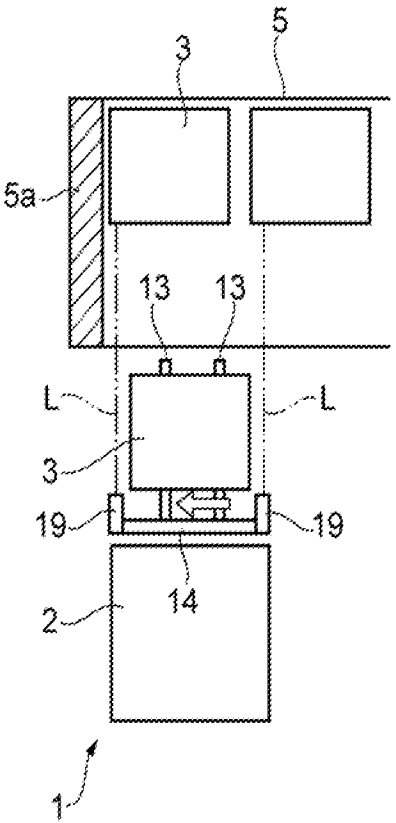

FIGS. 14A-14C are plan views schematically showing another placing motions of the forklift performed adjacently to the left side wall 5*a* of the container 5 by the first placing control process shown in FIG. 12. As illustrated in FIG. 14A, when the laser beam L emitted from the left 1D laser distance sensor 19 does not hit the left side wall 5*a* while the forklift 1 is stopped in front of and near the left side wall 5*a* of the container 5, the forks 13 are shifted to the left.

As illustrated in FIG. 14B, when the forks 13 are brought to a position (the placing starting position) in which the laser beam L emitted from the left 1D laser distance sensor 19 hits the left side wall 5*a*, the forks 13 stop the current shifting motion.

As illustrated in FIG. 14C, the forklift 1 is moved forward to the placing position, and the forks 13 are lowered at the stoppage position. With these motions, the box pallets 3 to be placed loaded on the forks 13 are placed on the floor surface of the container 5 adjacently to the left side wall 5*a*.

Figure 15:
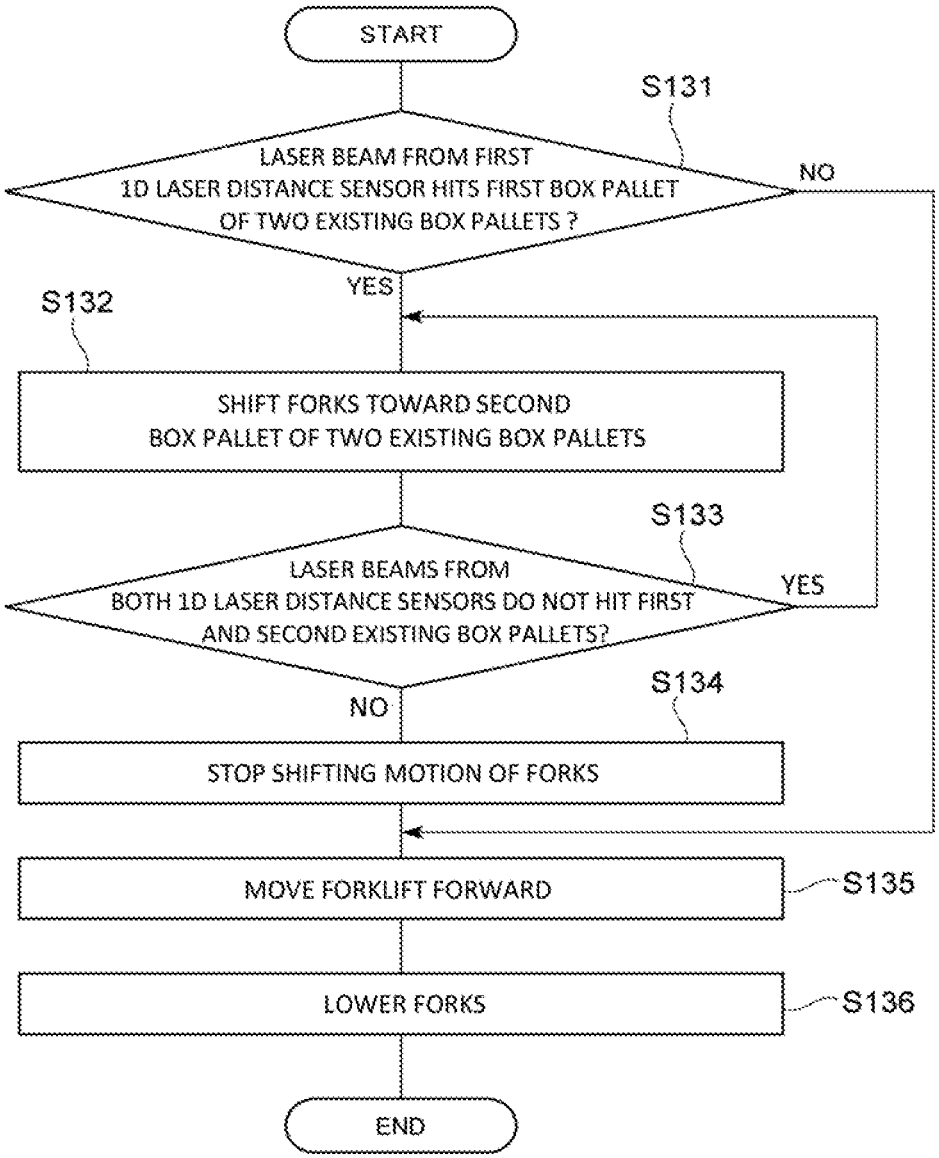
FIG. 15 is a flowchart showing detail steps of a second placing control process shown in FIG. 9.

FIG. 15 is a flowchart showing detailed steps (step 107) of the second placing control process shown in FIG. 9. It is noted that the second placing control process is executed by using detection values of the pair of right and left 1D laser distance sensors 19 located in the upper or lower end portion of the aluminum frames 21 similarly to the above first placing control process. Before the present placing control process is started, the forklift 1 is stopped in front of and near a middle position of the container 5 in the width direction (right and left direction) thereof. Two box pallets 3 (hereinafter, called box pallets 3A and 3B) have already been placed on the floor surface of the container 5 on the right and left sides thereof (see FIGS. 16A-16C). The forks 13 are set to a predetermined height.

As illustrated in FIG. 15, the ECU 20 determines whether or not a laser beam emitted from the first 1D laser distance sensor 19 of the pair of right and left 1D laser distance sensors 19 hits a first box pallet 3 of the existing box pallets 3A and 3B placed in advance on the basis of detection values of the 1D laser distance sensors 19 (step S131). It is noted that the first box pallet 3 is defined as the box pallet 3 of the existing box pallets 3A and 3B which a laser beam emitted from the first 1D laser distance sensor hits, and the second box pallet 3 is defined as the box pallet 3 of the existing box pallets 3A and 3B which a laser beam emitted from the second 1D laser distance sensor hits. Approximate distances between the 1D laser distance sensors 19 and the box pallets 3A and 3B are known in advance.

When the ECU 20 determines that a laser beam emitted from the first 1D laser distance sensor 19 of the pair of right and left 1D laser distance sensors 19 hits the first box pallet 3 of the existing box pallets 3A and 3B (see FIG. 16A) (YES at S131), the ECU 20 controls the side shift cylinder 17 so that the forks 13 are shifted toward the second box pallet 3 of the existing box pallets 3A and 3B (the second 1D laser distance sensor 19) (step S132).

Subsequently, the ECU 20 determines whether or not the laser beams emitted from both 1D laser distance sensors 19 hit the existing box pallets 3A and 3B on the basis of detection values of the pair of right and left 1D laser distance sensors 19 (step S133). When the ECU 20 determines that the laser beam from the first 1D laser distance sensor 19 still hits the first box pallet 3 of the existing box pallets 3A and 3B (YES at S133), the ECU 20 executes the step S132 again.

When the ECU 20 determines that the laser beams emitted from both 1D laser distance sensors 19 do not hit the existing box pallets 3A and 3B (see FIG. 16B) (NO at S133), the ECU 20 then determines the current position of the forks 13 as a placing start position, and controls the side shift cylinder 17 so that the forks 13 stop the current shifting motion (step S134). When the ECU 20 determines that the laser beams emitted from both 1D laser distance sensors 19 do not hit the existing box pallets 3A and 3B at the step S131 (NO at S131), the ECU 20 determines the current position of the forks 13 as a placing start position.

Subsequently, the ECU 20 controls the traveling motor 9 so that the forklift 1 is moved forward to the placing position (step S135). The ECU 20 controls the lift cylinder 15 so that the forks 13 are lowered by a predetermined amount (step S136). With this process, the box pallets 3 to be placed loaded on the forks 13 are placed on the floor surface of the container 5 (see FIG. 16C).

The steps S131 to S134 are executed by the placing SPD unit 33. The steps S135 and S136 are executed by the placing control unit 34.

Figure 16C:
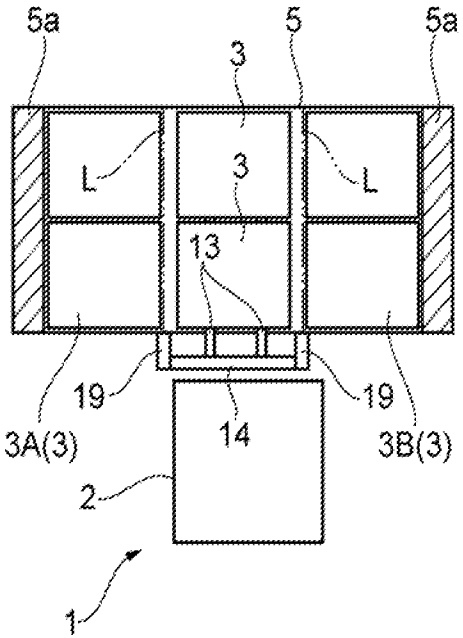
FIGS. 16A-16C are plan views schematically showing placing motions of the forklift, in which the forklift places cargos between two existing box pallets, by the second placing control process shown in FIG. 15.
Figure 16B:
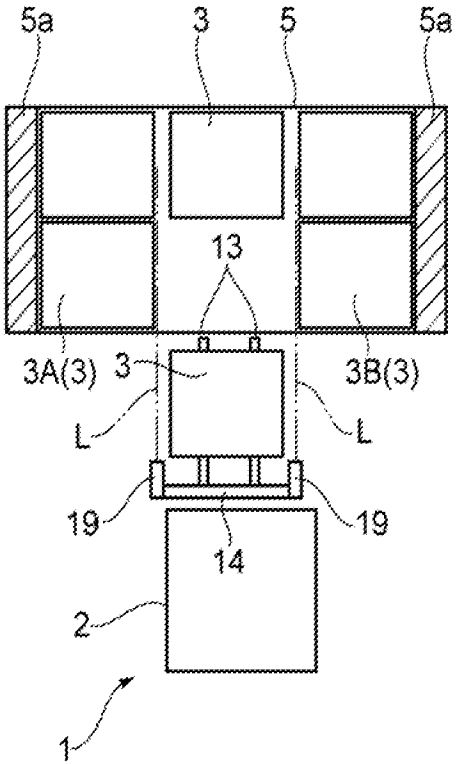
Figure 16A:
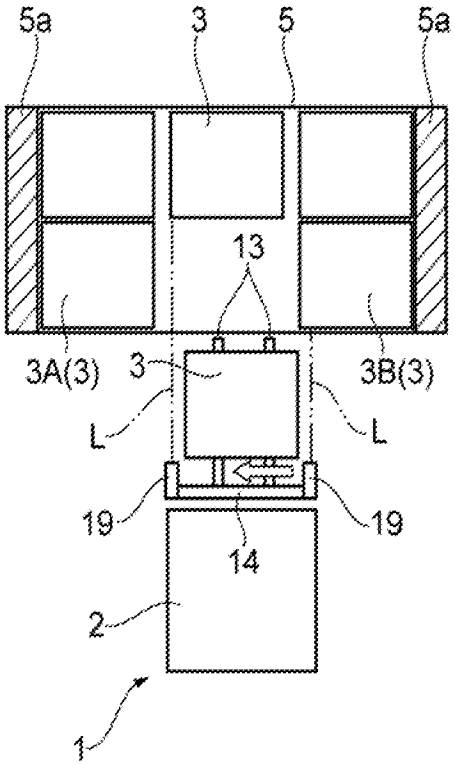

FIGS. 16A-16C are plan views schematically showing placing motions of the forklift, in which the forklift places a box pallet 3 between two existing box pallets 3A and 3B, by the second placing control process shown in FIG. 15. In the present embodiment, box pallets 3 have already been placed on the container 5 on a back side thereof and arranged in three rows. In addition, two box pallets 3 (box pallets 3A and 3B) have already been placed adjacently to the right and left side walls 5*a* of the container 5 on a front side of the thereof.

As illustrated in FIG. 16A, when the laser beam L emitted from the right 1D laser distance sensor 19 hits the existing box pallet 3B that is located on a right side of the forklift 1 while the forklift 1 is stopped in front of and near a middle position of the container 5 in the width direction thereof, the forks 13 are shifted to the left.

As illustrated in FIG. 16B, when the forks 13 are brought to a position in which the laser beam L emitted from the right 1D laser distance sensor 19 does not hit the existing box pallet 38 (placing start position), the forks 13 stop the current shifting motion.

As illustrated in FIG. 16C, the forklift 1 is moved forward to the placing position, and the forks 13 are lowered at the stoppage position. With these motions, the box pallet 3 to be placed loaded on the forks 13 is placed on the floor surface of the container 5 between the existing box pallets 3A and 3B.

In the present embodiment as described above, two pairs of right and left 1D laser distance sensors 19 are each configured to emit one-dimensional laser beam ahead of the forklift 1 and receive the laser beam reflected from an object that is located in front of the forklift 1, thereby detecting a distance between the object and the 1D laser distance sensor. A picking start position of the forks 13 for the box pallets 3 to be picked placed in front of the forklift 1 is determined on the basis of detection values of the pair of right and left 1D laser distance sensors 19. The traveling motor 9 and the lift cylinder 15 are controlled so that the box pallets 3 to be picked are loaded on the forks 13 correspondingly to the picking start position. Thus, the box pallets 3 to be picked are loaded on the forks 13 at a position corresponding to the picking start position. In addition, cost of each 1D laser distance sensor 19 is lower than that of a two-directional laser distance sensor. Therefore, the box pallets 3 may be loaded on the forks 13 at a predetermined position thereof with high accuracy using inexpensive laser distance sensors.

In the present embodiment, the 1D laser distance sensors 19 are attached on both right and left sides of the backrest 14. With this configuration, the 1D laser distance sensors 19 may be disposed on the cargo handling device 4 so that laser beams emitted from the 1D laser distance sensors 19 do not hit the box pallets 3 loaded on the forks 13.

In the present embodiment, the 1D laser distance sensors 19 are disposed behind the front surface 14*a* of the backrest 14. This configuration prevents the box pallets 3 loaded on the forks 13 from striking the 1D laser distance sensors 19.

In the present embodiment, the picking SPD unit 31 determines the current position of the forks 13 when the picking SPD unit 31 determines that laser beams emitted from the pair of right and left 1D laser distance sensors 19 do not hit the box pallets 3 to be picked as a picking start position. Thus, the picking start position of the forks 13 may be easily determined from detection values of the pair of right and left 1D laser distance sensors 19.

In the present embodiment, when the picking SPD unit 31 determines a laser beam emitted from the first 1D laser distance sensor of the pair of right and left 1D laser distance sensors 19 hits the box pallets 3 to be picked, the picking SPD unit 31 moves the forks 13 toward the first 1D laser distance sensor 19. Subsequently, the picking SPD unit 31 determines that the current position of the forks 13 when the picking SPD unit 31 then determines that the laser beams emitted from the pair of right and left 1D laser distance sensors 19 do not hit the box pallets 3 to be picked as a picking start position. Thus, even when the forks 13 are shifted to the left or right of the forklift 1 relative to the box pallets 3 placed in front of the forklift 1, a picking start position of the forks 13 may be determined.

In the present embodiment, when the picking SPD unit 31 determines that a laser beam emitted from the first 1D laser distance sensor of the pair of right and left 1D laser distance sensors 19 hits the box pallets 3 to be picked, the picking SPD unit 31 controls the side shift cylinder 17 so that the forks 13 are shifted from the normal position toward the first 1D laser distance sensor 19. Thus, the forks 13 may be moved toward the first 1D laser distance sensor 19 without moving the forklift 1 itself in the front and rear, and right and left direction.

In the present embodiment, after the picking control unit 32 controls the traveling motor 9 and the lift cylinder 15 correspondingly to the picking start position so that the box pallets 3 to be picked are loaded on the forks 13, the picking control unit 32 controls the side shift cylinder 17 so that the forks 13 return back to the normal position. This helps a control in the following process in which the box pallets 3 loaded on the forks 13 are placed on the container 5.

In the present embodiment, the placing SPD unit 33 determines a placing start position of the forks 13 on the basis of detection values of the pair of right and left 1D laser distance sensors 19, and controls the traveling motor 9 and the lift cylinder 15 so that the box pallets 3 to be placed loaded on the forks 13 are placed correspondingly to the placing start position. Thus, the box pallets 3 to be placed loaded on the forks 13 may be placed on the container 5 at an appropriate position thereof with high accuracy.

In the present embodiment, in a case in which the box pallets 3 to be placed are placed adjacently to either of the right and left side walls 5*a* of the container 5 existing in advance, the placing SPD unit 33 determines that the current position of the forks 13 when the placing SPD unit 33 determines that a laser beam emitted from the first 1D laser distance sensor 19 of the pair of right and left 1D laser distance sensors 19 hits the first side wall 5*a* as a placing start position. Thus, in that case, the placing start position of the forks 13 may be easily determined from detection values of the pair of right and left 1D laser distance sensors 19.

In the present embodiment, when the placing SPD unit 33 determines that the laser beams emitted from the pair of right and left 1D laser distance sensors 19 do not hit the first and second side walls 5*a*, the placing SPD unit 33 moves the forks 13 toward the first side wall 5*a*. Subsequently, the placing SPD unit 33 determines that the current position of the forks 13 when the placing SPD unit 33 then determines that the laser beam emitted from the first 1D laser distance sensor 19 of the pair of right and left 1D laser distance sensors 19 hits the first side wall 5*a* as a placing start position. Thus, even when a position of the box pallets 3 to be placed loaded on the forks 13 is shifted to the second side wall 5*a* on the opposite side of the first side wall 5*a* relative to a position on which the box pallets 3 are to be placed, a placing start position of the forks 13 may be determined.

In the present embodiment, when the placing SPD unit 33 determines that a laser beam emitted from the first 1D laser distance sensor 19 of the pair of right and left 1D laser distance sensors 19 hits the first side wall 5*a*, the placing SPD unit 33 moves the forks 13 toward the second side wall 5*a* on the opposite side of the first side wall 5*a* (toward the second 1D laser distance sensor 19). The placing SPD unit 33 moves the forks 13 toward the first side wall 5*a* when the placing SPD unit 33 then determines the laser beams emitted from the pair of right and left 1D laser distance sensors 19 do not hit the first and second side wall 5*a*. Thus, even when a position of the box pallets 3 to be placed loaded on the forks 13 is shifted toward either of the side walls 5*a* relative to a position on which the box pallets 3 are to be placed, a placing start position of the forks 13 may be determined.

In the present embodiment, when the placing SPD unit 33 moves the forks 13, the placing SPD unit 33 controls the side shift cylinder 17 so that the forks 13 are shifted. Thus, the forks 13 may be moved toward the first or second side wall 5*a* or away from the side walls 5*a* without moving the forklift 1 itself in the front and rear, and right and left direction.

In the present embodiment, in a case in which the box pallets 3 to be placed are placed between two existing box pallets 3 placed in advance, the placing SPD unit 33 determines the current position of the forks 13 when the placing SPD unit 33 determines that the laser beams emitted from the pair of right and left 1D laser distance sensors 19 do not hit the first and second existing box pallets 3 as a placing start position. Thus, in that case, the placing start position of the forks 13 may be easily determined from detection values of the pair of right and left 1D laser distance sensors 19.

In the present embodiment, when the placing SPD unit 33 determines that a laser beam emitted from the first 1D laser distance sensor 19 of the pair of right and left 1D laser distance sensors 19 hits the first box pallet 3 of two existing box pallets 3, the placing SPD unit 33 moves the forks 13 toward the second box pallet 3 of the two existing box pallets 3. Subsequently, the placing SPD unit 31 determines that the current position of the forks 13 when the placing SPD unit 33 then determines that the laser beams emitted from the pair of right and left 1D laser distance sensors 19 do not hit the first and second box pallet 3 as a placing start position. Thus, even when a position of the box pallets 3 to be placed loaded on the forks 13 is shifted toward either of two existing box pallets 3 relative to a position on which the box pallets 3 are to be placed, a placing start position of the forks 13 may be determined.

In the present embodiment, when the placing SPD unit 33 determines that a laser beam emitted from the first 1D laser distance sensor 19 of the pair of right and left 1D laser distance sensors 19 hits the first existing box pallet 3, the placing SPD unit 33 controls the side shift cylinder 17 so that the forks 13 are shifted toward the second existing box pallet 3. Thus, the forks 13 may be moved toward the second existing box pallet 3 without moving the forklift 1 itself in the front and rear, and right and left direction.

Figure 17:
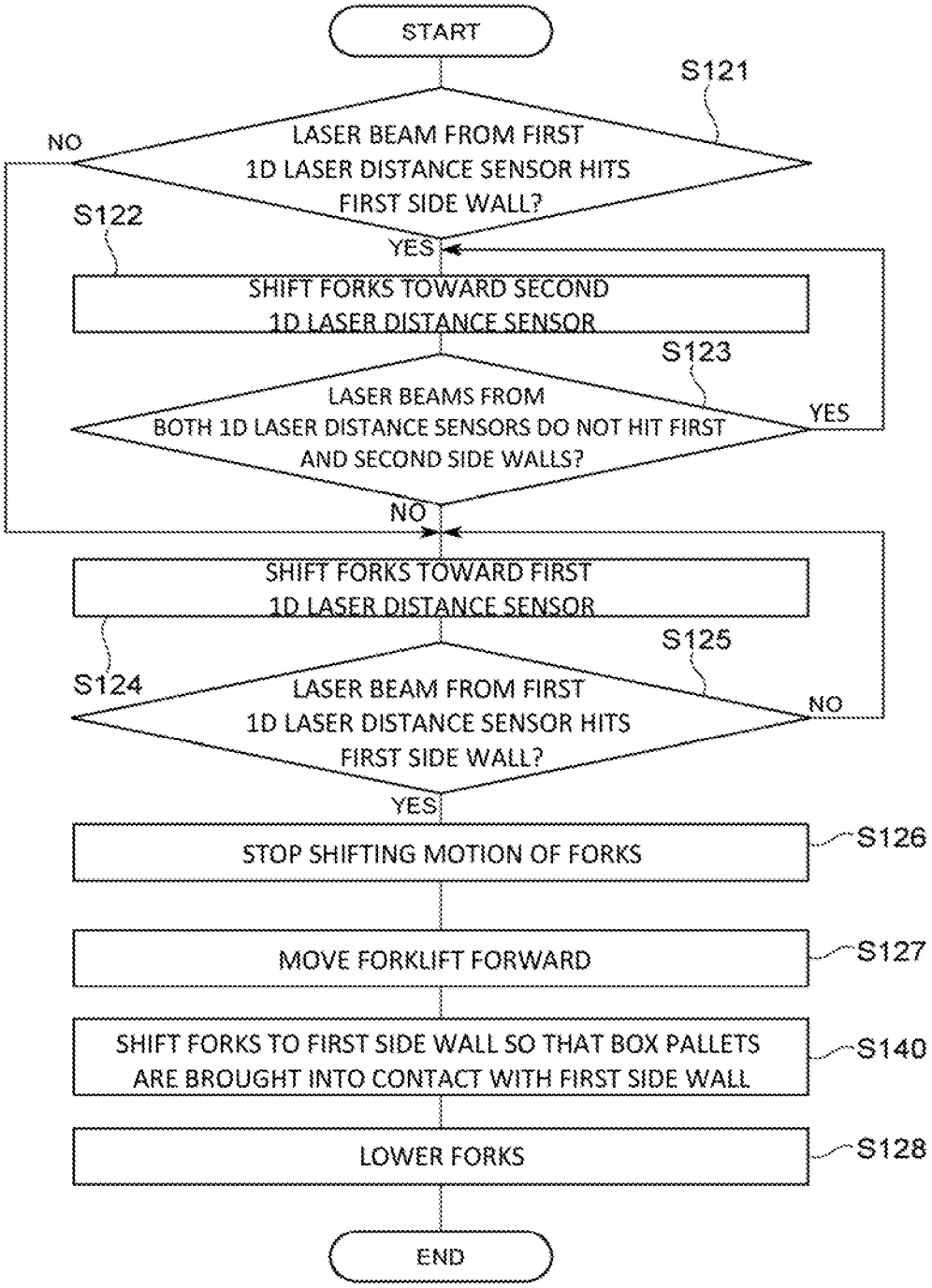
FIG. 17 is a flowchart showing a modification of the steps of the first placing control process shown in FIG. 12 in a cargo handling control unit according to another embodiment of the present disclosure.

FIG. 17 is a flowchart showing a modification of the steps of the first placing control process shown in FIG. 12 in a cargo handling control unit according to another embodiment of the present disclosure. As illustrated in FIG. 17, the ECU 20 executes the steps S121 to S127 similarly to the first placing control process as shown in FIG. 12.

After the ECU 20 executes the step S127, the ECU 20 controls the side shift cylinder 17 so that the box pallets 3 to be placed loaded on the forks 13 are shifted toward the first side wall 5*a* until the box pallets 3 are brought into contact with the first side wall 5*a* of the container 5 (step S140). In this time, the ECU 20 shifts the forks 13 by, for example, a distance where the width dimension of each box pallet 3 is subtracted from a distance between the pair of right and left 1D laser distance sensors 19. With this motion, the box pallets 3 to be placed are brought into contact with the first side wall 5*a* (see FIG. 18C). The ECU 20 executes the step 128 similarly to the first placing control process as shown in FIG. 12.

The steps S127, S140, and S128 are executed by the placing control unit 34.

Figure 18A:
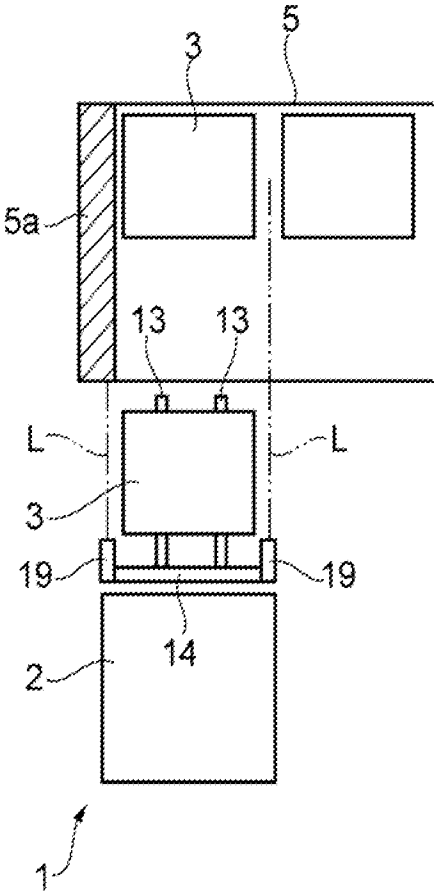
FIGS. 18A-18C are plan views schematically showing placing motions of the forklift performed adjacently to the side wall of the container by the first placing control process shown in FIG. 17.
Figure 18B:
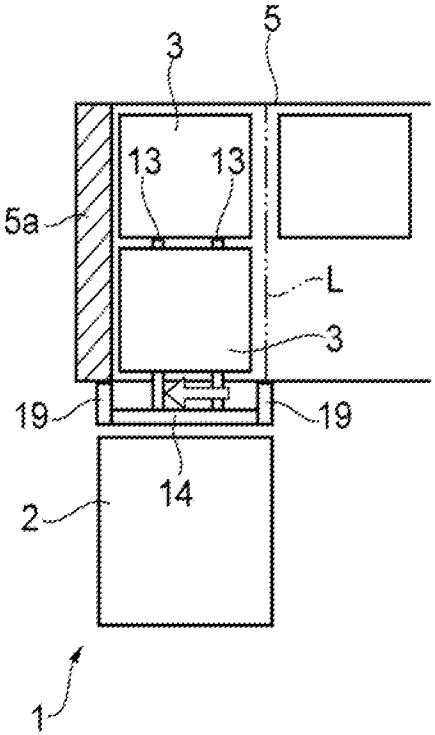
Figure 18C:
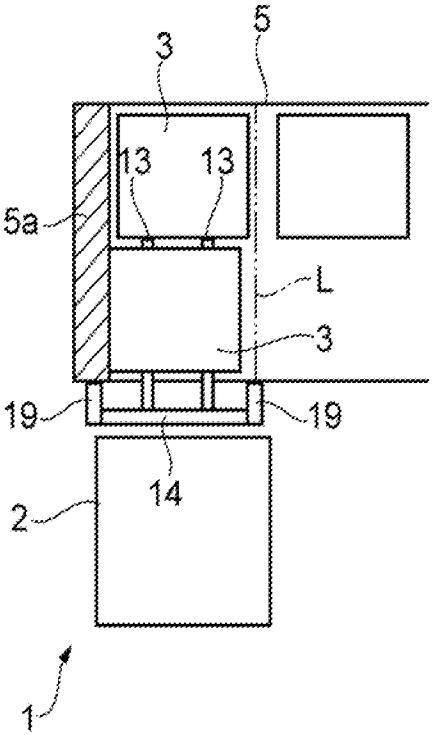

FIGS. 18A-18C are plan views schematically showing placing motions of the forklift 1 performed adjacently to the left side wall 5*a* of the container 5 by the first placing control process shown in FIG. 17. As illustrated in FIG. 18A, when the forks 13 are brought to a position (placing start position) in which the laser beam L emitted from the left 1D laser distance sensor 19 hits the left side wall 5*a*, the forks 13 stop the current shifting motion.

As illustrated in FIG. 18B, the forklift 1 is moved forward to a placing position. When the forks 13 are shifted toward the left side wall 5*a* at the moved position, the box pallets 3 to be placed loaded on the forks 13 are brought into contact with the left side wall 5*a* as illustrated in FIG. 18C. Subsequently, the forks 13 are lowered. With these motions, the box pallets 3 to be placed are placed on the floor surface of the container 5 adjacently to the left side wall 5*a* so that the box pallets 3 are brought into contact with the left side wall 5*a*.

In the present embodiment as described above, the forks 13 are shifted toward the first side wall 5*a* of the container 5 so that the box pallets 3 to be placed are brought into contact with the first side wall 5*a*. This process increases the space between the two existing box pallets 3 compared with FIG. 16A, when the box pallets 3 to be placed are placed between the two existing box pallets 3 placed in advance in the following process. Thus, the box pallets 3 to be placed may be easily placed between the two existing box pallets 3.

Figure 19:
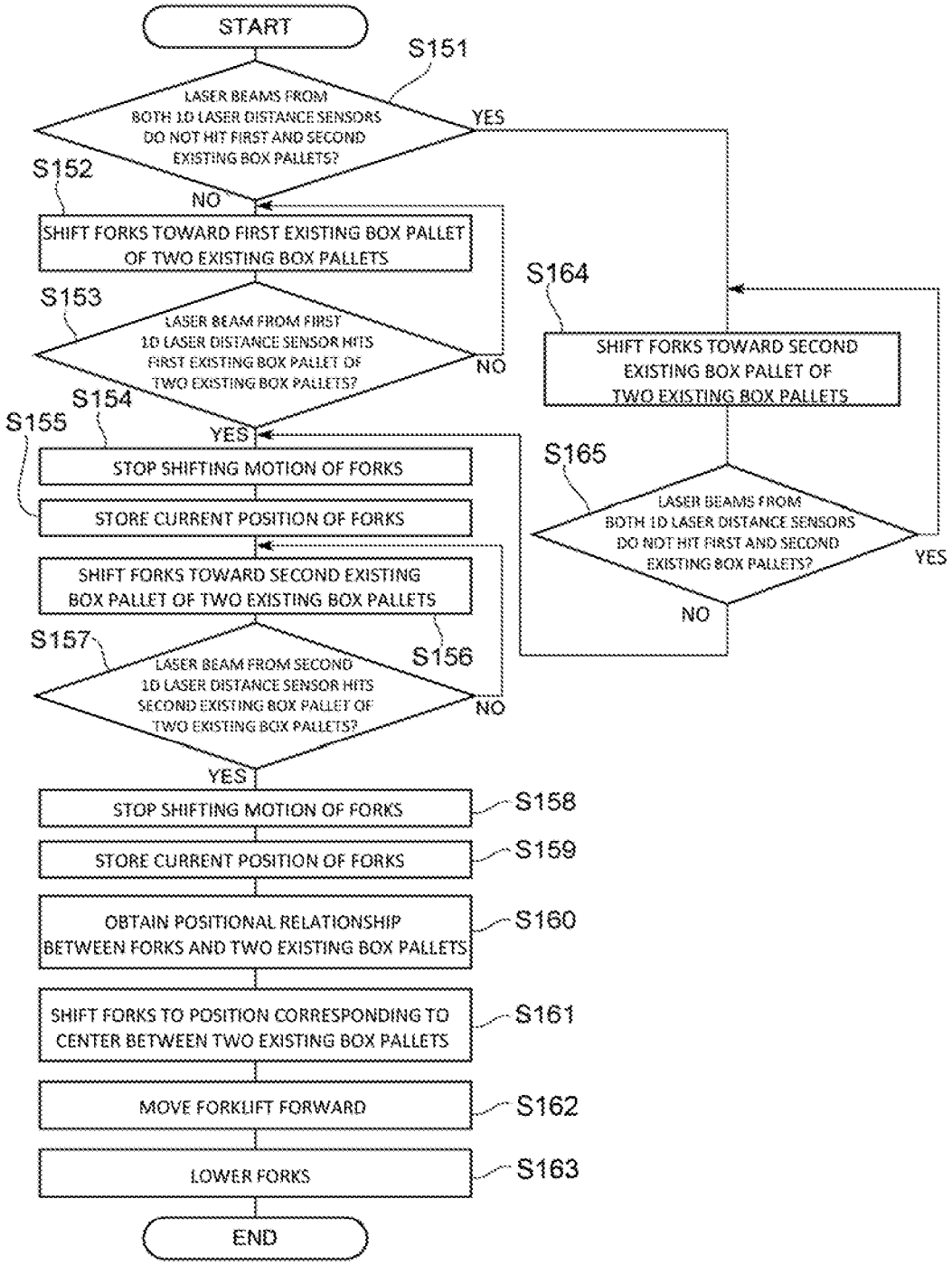
FIG. 19 is a flowchart showing a modification of the steps of the second placing control process shown in FIG. 15 in a cargo handling control unit according to still another embodiment of the present disclosure.

FIG. 19 is a flowchart showing a modification of the steps of the second placing control process shown in FIG. 15 in a cargo handling control unit according to still another embodiment of the present disclosure. As illustrated in FIG. 19, in the present embodiment, the ECU 20 firstly determines whether or not laser beams emitted from the pair of right and left 1D laser distance sensors 19 hit the existing box pallets 3A and 3B placed in advance on the basis of detection values of both 1D laser distance sensors 19 (step S151).

When the ECU 20 determines that the laser beams emitted from both 1D laser distance sensors 19 do not hit the existing box pallets 3A and 3B (see FIG. 20A) (NO at S151), the ECU 20 controls the side shift cylinder 17 so that the forks 13 are shifted toward the first box pallet 3 of the existing box pallets 3A and 3B (step S152).

Subsequently, the ECU 20 determines whether or not the laser beam emitted from the first 1D laser distance sensor 19 of the pair of right and left 1D laser distance sensors 19 hits the first box pallet 3 of the existing box pallets 3A and 3B on the basis of detection values of the pair of right and left 1D laser distance sensors 19 (step S153). When the ECU 20 determines that the laser beams emitted from both 1D laser distance sensors 19 do not hit the existing box pallets 3A and 3B (NO at S153), the ECU 20 executes the step 152 again.

When the ECU 20 determines that the laser beams emitted from the first 1D laser distance sensor 19 hits the first box pallet 3 of the existing box pallets 3A and 3B (see FIG. 20B) (YES at S153), the ECU 20 controls the side shift cylinder 17 so that the forks 13 stop the current shifting motion (step S154). The ECU 20 then stores the current position of the forks 13 (step S155). Subsequently, the ECU 20 controls the side shift cylinder 17 so that the forks 13 are shifted toward the second box pallet 3 of the existing box pallets 3A and 3B (step S156).

Subsequently, the ECU 20 determines whether or not the laser beam emitted from the second 1D laser distance sensor 19 of the pair of right and left 1D laser distance sensors 19 hits the second box pallet 3 of the existing box pallets 3A and 3B on the basis of detection values of the pair of right and left 1D laser distance sensors 19 (step S157). When the ECU 20 determines that the laser beams emitted from both 1D laser distance sensors 19 do not hit the existing box pallets 3A and 3B (NO at S157), the ECU 20 executes the step 156 again.

When the ECU 20 determines that the laser beam emitted from the second 1D laser distance sensor 19 hits the second box pallet 3 of the existing box pallets 3A and 3B (see FIG. 20C) (YES at S157), the ECU 20 controls the side shift cylinder 17 so that the forks 13 stop the current shifting motion (step S158). The ECU 20 then stores a position of the forks 13 (step S159).

Subsequently, the ECU 20 obtains a positional relationship between the forks 13 and the existing box pallets 3A and 3B by using the positions of the forks 13 stored at the steps S155 and S159 (step S160). The ECU 20 determines a position corresponding to a middle position between the existing box pallets 3A and 3B as a placing start position, and controls the side shift cylinder 17 so that the forks 13 are shifted to the placing start position (step S161).

Subsequently, the ECU 20 controls the traveling motor 9 so that the forklift 1 is moved forward from the placing start position to the placing position (step S162). The ECU 20 controls the lift cylinder 15 so that the forks 13 are lowered by a predetermined amount (step S163). With this process, the box pallets 3 to be placed loaded on the forks 13 are placed on the floor surface of the container 5 (see FIG. 20D).

When the ECU 20 determines that the laser beam emitted from the first 1D laser distance sensor 19 hits the first box pallet 3 of the existing box pallets 3A and 3B at step S151 (YES at S151), the ECU 20 controls the side shift cylinder 17 so that the forks 13 are shifted from the first box pallet 3 toward the second box pallet 3 of the existing box pallets 3A and 3B (step S164).

Subsequently, the ECU 20 determines whether or not the laser beams emitted from the pair of right and left 1D laser distance sensors 19 hit the existing box pallets 3A and 3B on the basis of detection values of both 1D laser distance sensors 19 (step S165). When the ECU 20 determines that the laser beam from the first 1D laser distance sensor 19 hits the first box pallet 3 of the existing box pallets 3A and 3B (YES at S165), the ECU 20 executes the step S164 again.

When the ECU 20 determines that the laser beams emitted from both 1D laser distance sensors 19 do not hit the box pallets 3A and 3B (NO at S165), the ECU 20 controls the side shift cylinder 17 so that the forks 13 stop the current shifting motion (step S154). The ECU 20 executes the above steps S155 to S163 sequentially.

The steps S151 to S161, S164, and S165 are executed by the placing SPD unit 33. The steps S161 to S163 are executed by the placing control unit 34. The steps S154 and S158 may be omitted.

Figure 20A:
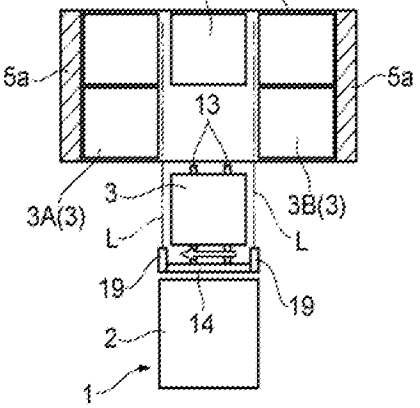
FIGS. 20A-20D are plan views schematically showing placing motions of the forklift, in which the forklift places cargos between two existing box pallets by the second placing control process shown in FIG. 19.

FIGS. 20A-20D are plan views schematically showing placing motions of the forklift 1, in which the forklift 1 places cargos between two existing box pallets by the second placing control process shown in FIG. 19. As illustrated in FIG. 20A, in a case that the forklift 1 is stopped in front of and near a middle position of the container 5 in the width direction thereof, when laser beams L emitted from both right and left 1D laser distance sensors 19 do not hit the existing box pallets 3A and 3B placed in advance, the forks 13 are shifted to the left.

Figure 20B:
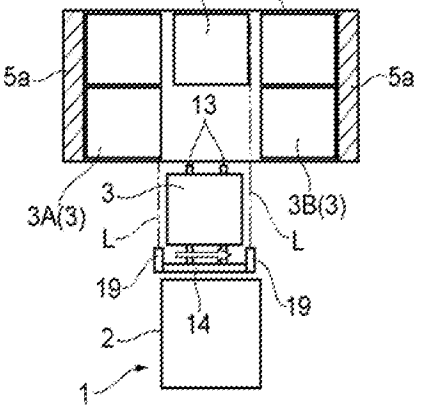

As illustrated in FIG. 20B, when a laser beam emitted from the left 1D laser distance sensor 19 hits the existing box pallet 3A, the current position of the forks 13 is stored by the ECU 20, and then, the forks 13 are shifted to the right.

Figure 20C:
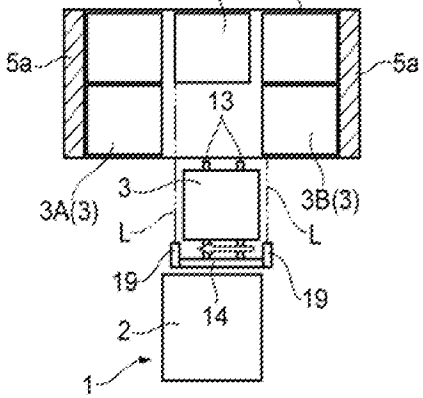

As illustrated in FIG. 20C, when the laser beam L emitted from the right 1D laser distance sensor 19 hits the existing box pallet 3B, the current position of the forks 13 is stored by the ECU 20. Thus, a positional relationship between the forks 13 and the existing box pallets 3A and 3B are obtained. The forks 13 are shifted to the left to a position corresponding to a middle position between the existing box pallets 3A and 3B.

Figure 20D:
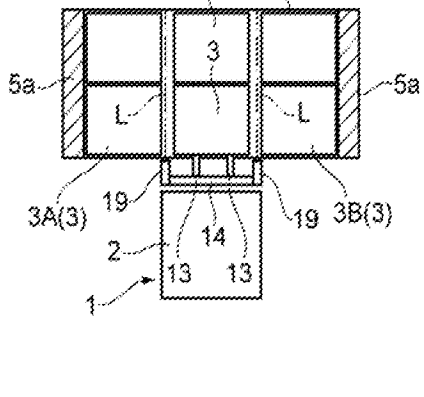

As illustrated in FIG. 20D, the forklift 1 is moved forward to the placing position, and the forks 13 are lowered at the shifted position. With these motions, the box pallets 3 to be placed loaded on the forks 13 are placed on the floor surface of the container 5 between the existing box pallets 3A and 3B.

In the present embodiment as described above, the placing SPD unit 33 controls the side shift cylinder 17 so that the forks 13 are shifted toward the second existing box pallet 3 from a position in which a laser beam emitted from the first 1D laser distance sensor 19 of the pair of right and left 1D laser distance sensors 19 hits the first existing box pallet 3 of the two existing box pallets 3 to a position in which a laser beam emitted from the second 1D laser distance sensor 19 of the pair of right and left 1D laser distance sensors 19 hits the second existing box pallet 3 of the two existing box pallets 3. The placing SPD unit 33 obtains a positional relationship between the forks 13 and the two existing box pallets 3, and determines a position corresponding to the middle position between the two existing box pallets 3 as a placing start position. Therefore, in the present embodiment, the box pallets 3 to be placed may be placed on an appropriate position that is the middle position between the two existing box pallets 3.

The present disclosure is not limited to the above embodiments. For example, in the above embodiments, the 1D laser distance sensors 19 are attached on both right and left sides of the backrest 14. However, the 1D laser distance sensors 19 may be attached on both right and left side of the lift bracket 12.

In the above embodiments, the box pallets 3 are stacked in two tiers, and two 1D laser distance sensors 19 are attached to the cargo handling device 4 on the right and left sides thereof and located in upper and lower direction of the cargo handling device 4. However, the present disclosure is not limited to the embodiments. A pair of right and left 1D laser distance sensors 19 or some pairs of right and left 1D laser distance sensors may be disposed corresponding to the number of tiers of the stacked box pallets 3, or only a pair of right and left 1D laser distance sensors 19 may be disposed regardless of the number of tiers of the stacked box pallets 3.

In the above embodiments, the cargo handling device 4 has the side shift cylinder 17 that shifts the forks 13 relative to the mast 11 in the right and left direction of the forklift 1. However, the present disclosure may be applied to a forklift on which such a side shift cylinder is not mounted. In such case, the ECU 20 moves the forklift 1 itself by controlling the traveling motor 9 and the steering motor 10 so as to move the forks 13 in a transverse direction (right and left direction) of the forklift 1.

In the above embodiments, the box pallets 3 are placed on the container 5 in which the side walls 5*a* are provided on both right and left sides of the container 5. However, the present disclosure is not limited to the embodiments. For example, the box pallets 3 may be placed on a storage structure that has an existing structure such as a wall and a pillar.

In the above embodiments, the box pallets 3 are placed on the container 5 and arranged in three rows. However, the box pallets 3 may be arranged not in three rows but in two rows or in four or more rows.

In the above embodiments, the box pallets 3 are loaded on the forks 13, and placed on the container 5. However, cargos of cargo handling objects are not limited to the box pallets 3.

In the above embodiments, the ECU 20 executes a cargo handling control process on the basis of instruction signals of the higher system management unit 25. However, the present disclosure is not limited to the embodiments. The ECU 20 may execute a cargo handling control process, for example, in accordance with a predetermined program or while determining a working state by using a camera and the like.

In the above embodiments, the picking work and the placing work are performed by the automatic operation of the forklift 1. However, the present disclosure is not limited to the embodiments. The present disclosure may be applied during manual driving of the forklift 1.

In the above embodiments, the cargo handling control unit 18 is mounted on the counter-type forklift 1. However, the present disclosure may be applied to a reach-type forklift and the like.

What is claimed is:

1. A cargo handling control unit of a forklift comprising:

a traveling device including a traveling drive unit;

forks disposed in a front side of the traveling device and loading cargos; and a cargo handling device having a lift cylinder that raises and lowers the forks, wherein the cargo handling control unit includes:

at least a pair of right and left one-dimensional laser distance sensors disposed on both right and left sides of the cargo handling device, each of the right and left one-dimensional laser distance sensors being configured to emit a one-dimensional laser beam ahead of the forklift and receive the laser beam reflected from an object that is located in front of the forklift, thereby detecting a distance between the object and the one-dimensional laser distance sensor;

a picking start position determination unit determining a picking start position of the forks for the cargos to be picked placed in front of the forklift on the basis of detection values of the pair of the right and left one-dimensional laser distance sensors; and a picking control unit configured to control the traveling drive unit and the lift cylinder so as to load the cargos to be picked on the forks correspondingly to the picking start position determined by the picking start position determination unit wherein the cargo handling device has:

a mast provided upright on a front end portion of a body of the traveling device; and a backrest disposed in front of the mast, the forks are attached to the mast with a lift bracket interposed therebetween and allowed to be raised and lowered, the backrest is fixed to the lift bracket, and the one-dimensional laser distance sensors are attached on both right and left sides of the backrest or the lift bracket, the picking start position determination unit determines whether or not the laser beams emitted from the pair of the right and left one-dimensional laser distance sensors hit the cargos to be picked on the basis of the detection values of the pair of the right and left one-dimensional laser distance sensors, and determines a position of the forks when the picking start position determination unit determines that the laser beams emitted from the one-dimensional laser distance sensors do not hit the cargos to be picked as the picking start position, when the picking start position determination unit determines that the laser beam emitted from the first one-dimensional laser distance sensor of the pair of the right and left one-dimensional laser distance sensors hits the cargos to be picked, the picking start position determination unit moves the forks toward the first one-dimensional laser distance sensor, and determines that a position of the forks when the picking start position determination unit then determines that the laser beams emitted from the pair of the right and left one-dimensional laser distance sensors do not hit the cargos to be picked as the picking start position.

2. The cargo handling control unit of the forklift according to claim 1, wherein the cargo handling device has a side shift cylinder that shifts the forks in a right and left direction of the body relative to the mast, and when the picking start position determination unit determines that the laser beam emitted from the first one-dimensional laser distance sensor of the pair of the right and left one-dimensional laser distance sensors hits the cargos to be picked, the picking start position determination unit controls the side shift cylinder so that the forks are shifted from a normal position toward the first one-dimensional laser distance sensor.

3. The cargo handling control unit of the forklift according to claim 2, wherein after the picking control unit controls the traveling drive unit and the lift cylinder correspondingly to the picking start position so that the cargos to be picked are loaded on the forks, the picking control unit controls the side shift cylinder so that the forks return back to the normal position.

4. A cargo handling control unit of a forklift comprising:

a traveling device including a traveling drive unit forks disposed in a front side of the traveling device and loading cargos; and a cargo handling device having a lift cylinder that raises and lowers the forks, wherein the cargo handling control unit includes:

at least a pair of right and left one-dimensional laser distance sensors disposed on both right and left sides of the cargo handling device, each of the right and left one-dimensional laser distance sensors being configured to emit a one-dimensional laser beam ahead of the forklift and receive the laser beam reflected from an object that is located in front of the forklift, thereby detecting a distance between the object and the one-dimensional laser distance sensor;

a picking start position determination unit determining a picking start position of the forks for the cargos to be picked placed in front of the forklift on the basis of detection values of the pair of the right and left one-dimensional laser distance sensors; and a picking control unit configured to control the traveling drive unit and the lift cylinder so as to load the cargos to be picked on the forks correspondingly to the picking start position determined by the picking start position determination unit, wherein the cargo handling device has:

a mast provided upright on a front end portion of a body of the traveling device; and a backrest disposed in front of the mast, the forks are attached to the mast with a lift bracket interposed therebetween and allowed to be raised and lowered, the backrest is fixed to the lift bracket, and the one-dimensional laser distance sensors are attached on both right and left sides of the backrest or the lift bracket, wherein the cargo handling control unit of the forklift further includes:

a placing start position determination unit determining a placing start position of the forks on the basis of the detection values of the pair of the right and left one-dimensional laser distance sensors, and a placing control unit configured to control the traveling drive unit and the lift cylinder correspondingly to the placing start position determined by the placing start position determination unit so as to place the cargos to be placed loaded on the forks, wherein in a case in which the cargos to be placed are placed adjacently to a structure existing in advance, the placing start position determination unit determines whether or not the laser beam emitted from the first one-dimensional laser distance sensor of the pair of the right and left one-dimensional laser distance sensors hits the structure on the basis of the detection values of the pair of the right and left one-dimensional laser distance sensors, and the placing start position determination unit determines a position of the forks when the laser beam emitted from the first one-dimensional laser distance sensor hits the structure as the placing start position.

5. The cargo handling control unit of the forklift according to claim 4, wherein when the placing start position determination unit determines that the laser beams emitted from the pair of the right and left one-dimensional laser distance sensors do not hit the structure, the placing start position determination unit moves the forks toward the structure, and determines that a position of the forks when the placing start position determination unit then determines that the laser beam emitted from the first one-dimensional laser distance sensor of the pair of the right and left one-dimensional laser distance sensors hits the structure as the placing start position.

6. The cargo handling control unit of the forklift according to claim 5, wherein when the placing start position determination unit determines that the laser beam emitted from the first one-dimensional laser distance sensor of the pair of the right and left one-dimensional laser distance sensors hits the structure, the placing start position determination unit moves the forks toward a second one-dimensional laser distance sensor, and moves the forks toward the structure when the placing start position determination unit determines that the laser beams emitted from the pair of the right and left one-dimensional laser distance sensors do not hit the structure.

7. The cargo handling control unit of the forklift according to claim 5, wherein the cargo handling device has the side shift cylinder that shifts the forks relative to the mast in the right and left direction of the body, and when the placing start position determination unit moves the forks, the placing start position determination unit controls the side shift cylinder so that the forks are shifted.

8. The cargo handling control unit of the forklift according to claim 7, wherein after the placing control unit controls the traveling drive unit so that the forklift is moved forward from the placing start position, the placing control unit controls the side shift cylinder so that the forks are shifted toward the structure until the cargos are brought into contact with the structure, and controls the lift cylinder so that the forks are then lowered.

9. A cargo handling control unit of a forklift comprising:

a traveling device including a traveling drive unit forks disposed in a front side of the traveling device and loading cargos; and a cargo handling device having a lift cylinder that raises and lowers the forks, wherein the cargo handling control unit includes:

at least a pair of right and left one-dimensional laser distance sensors disposed on both right and left sides of the cargo handling device, each of the right and left one-dimensional laser distance sensors being configured to emit a one-dimensional laser beam ahead of the forklift and receive the laser beam reflected from an object that is located in front of the forklift, thereby detecting a distance between the object and the one-dimensional laser distance sensor;

a picking start position determination unit determining a picking start position of the forks for the cargos to be picked placed in front of the forklift on the basis of detection values of the pair of the right and left one-dimensional laser distance sensors; and a picking control unit configured to control the traveling drive unit and the lift cylinder so as to load the cargos to be picked on the forks correspondingly to the picking start position determined by the picking start position determination unit, wherein the cargo handling device has:

a mast provided upright on a front end portion of a body of the traveling device; and a backrest disposed in front of the mast, the forks are attached to the mast with a lift bracket interposed therebetween and allowed to be raised and lowered, the backrest is fixed to the lift bracket, and the one-dimensional laser distance sensors are attached on both right and left sides of the backrest or the lift bracket, wherein the cargo handling control unit of the forklift further includes:

a placing start position determination unit determining a placing start position of the forks on the basis of the detection values of the pair of the right and left one-dimensional laser distance sensors, and a placing control unit configured to control the traveling drive unit and the lift cylinder correspondingly to the placing start position determined by the placing start position determination unit so as to place the cargos to be placed loaded on the forks, wherein in a case in which the cargos to be placed are placed between two existing cargos placed in advance, the placing start position determination unit determines whether or not the laser beams emitted from the pair of the right and left one-dimensional laser distance sensors hit the two existing cargos, and determines a position of the forks as the placing start position, when the placing start position determination unit determines that the laser beams emitted from the pair of the right and left one-dimensional laser distance sensors do not hit the two existing cargos.

10. The cargo handling control unit of the forklift according to claim 9, wherein when the placing start position determination unit determines that the laser beam emitted from the first one-dimensional laser distance sensor of the pair of the right and left one-dimensional laser distance sensors hits a first existing cargo of the two existing cargos, the placing start position determination unit moves the forks toward a second existing cargo of the two existing cargos, and determines a position of the forks when the placing start position determination unit then determines that the laser beams emitted from the pair of the right and left one-dimensional laser distance sensors do not hit the two existing cargos as the placing start position.

11. The cargo handling control unit of the forklift according to claim 10, wherein the cargo handling device has the side shift cylinder that shifts the forks relative to the mast in the right and left direction of the body, and when the placing start position determination unit determines that the laser beam emitted from the first one-dimensional laser distance sensor of the pair of the right and left one-dimensional laser distance sensors hits the first existing cargo, the placing start position determination unit controls the side shift cylinder so that the forks are shifted toward the second existing cargo.

12. The cargo handling control unit of the forklift according to claim 11, wherein the placing start position determination unit i) controls the side shift cylinder so that the forks are shifted toward the second existing cargo from a position in which the laser beam emitted from the first one-dimensional laser distance sensor of the pair of the right and left one-dimensional laser distance sensors hits the first existing cargo to a position in which the laser beam emitted from the second one-dimensional laser distance sensor of the pair of the right and left one-dimensional laser distance sensors hits the second existing cargos, ii) obtains a positional relationship between the forks and the two existing cargos, and iii) determines a position corresponding to a middle position between the two existing cargos as the placing start position, and the placing control unit controls the side shift cylinder so that the forks are shifted to the placing start position, and controls the traveling drive unit so that the forklift is then moved forward from the placing start position and controls the lift cylinder so that the forks are lowered.

* * * * *